US012319396B2

(12) United States Patent
Udvary

(10) Patent No.: US 12,319,396 B2
(45) Date of Patent: Jun. 3, 2025

(54) VESSEL PROPELLING SYSTEM AND ASSEMBLY

(71) Applicant: Seamach Pty Ltd., Victoria (AU)

(72) Inventor: Timothy Peter Udvary, Victoria (AU)

(73) Assignee: Seamach Pty Ltd., Victoria (AU)

( * ) Notice: Subject to any disclaimer, the term of this patent is extended or adjusted under 35 U.S.C. 154(b) by 576 days.

(21) Appl. No.: 17/540,379

(22) Filed: Dec. 2, 2021

(65) Prior Publication Data

US 2022/0177098 A1 Jun. 9, 2022

Related U.S. Application Data

(60) Provisional application No. 63/120,935, filed on Dec. 3, 2020.

(51) Int. Cl.

| | |
|---|---|
| ***B63H 11/08*** | (2006.01) |
| ***B63H 1/14*** | (2006.01) |
| ***B63H 11/04*** | (2006.01) |
| ***B63H 11/107*** | (2006.01) |
| ***B63H 11/113*** | (2006.01) |
| ***B63H 20/14*** | (2006.01) |
| ***B63H 23/36*** | (2006.01) |

(52) U.S. Cl.

CPC ..... *B63H 11/08* (2013.01); *B63H 11/04* (2013.01); *B63H 11/107* (2013.01); *B63H 11/113* (2013.01); *B63H 20/14* (2013.01); *B63H 23/36* (2013.01); *B63H 2001/145* (2013.01); *B63H 2011/081* (2013.01)

(58) Field of Classification Search

CPC ..... B63H 11/08; B63H 11/04; B63H 11/107; B63H 11/113; B63H 20/14; B63H 23/36; B63H 2001/145; B63H 2011/081

See application file for complete search history.

(56) References Cited

U.S. PATENT DOCUMENTS 3,842,787 A † 10/1974 Giacosa
4,281,996 A 8/1981 Mouraret
(Continued)

FOREIGN PATENT DOCUMENTS

CA 2698429 † 10/2010
WO 8403077 A1 8/1984
(Continued)

OTHER PUBLICATIONS

International Search Report and Written Opinion issued on Feb. 17, 2022 for corresponding PCT Application No. PCT/IB2021/061260.
European Search report; dated Oct. 14, 2024; Application # 21900196.3.
(Continued)

*Primary Examiner* — Stephen P Avila
(74) *Attorney, Agent, or Firm* — Polsinelli PC; Babak Monajemi

(57) ABSTRACT

The present disclosure relates to a vessel propelling mechanism. In one aspect, a vessel propelling system includes a motor and a waterjet system. The waterjet system is coupled to the motor and includes a stator with a plurality of blades. A first blade of the plurality of blades has a shape that is different than remaining blades of the plurality of blades, the shape of the first blade allowing a driving mechanism of the motor to be coupled to a shaft within the waterjet system.

16 Claims, 21 Drawing Sheets

(56) References Cited

U.S. PATENT DOCUMENTS

| | | | | |
|---|---|---|---|---|
| 4,993,977 | A | 2/1991 | Rodler, Jr. | |
| 6,193,569 | B1 | 2/2001 | Davies et al. | |
| 6,267,632 | B1 * | 7/2001 | Blanchard | B63H 11/08 440/38 |
| 6,293,842 | B1 * | 9/2001 | Belt | B63H 21/305 440/38 |
| 2016/0039506 | A1 | 2/2016 | Okamoto | |
| 2018/0170500 | A1 | 6/2018 | Desch et al. | |

FOREIGN PATENT DOCUMENTS

| | | | |
|---|---|---|---|
| WO | 9815453 | A1 | 4/1998 |
| WO | 2013/006064 | A1 | 1/2013 |

OTHER PUBLICATIONS

I) Screen captures from YouTube video entitled "Technology Jet Drive OXE 300Hp", uploaded on the of Mar. 5, 2023 by user "Ary Adriansyah" at https://www.youtube.com/watch?=CHwlNywnedY. Date accessed Aug. 12, 2023. (ii) Link contains public introduction and announcement of OXE diesel waterjet at Workboat Show. •Author: Ken Hocke • Title: "Diesel Outboards, OXE, Jet-Tech Introduce new waterjet at Workboat Show" • Date of Publication: Nov. 30, 2021. • pp. 1 of 1. • URL / Place of Publication: https://www.workboat.com/people-products/diesel-outboards-oxe-marine-and-jet-tech-to-introduce-new-waterjet-at-workboat-show • Date accessed: Aug. 12, 2023.†

* cited by examiner
† cited by third party

VESSEL PROPELLING SYSTEM AND ASSEMBLY

CROSS REFERENCE TO RELATED APPLICATIONS

This application claims priority to U.S. Provisional Application 63/120,935 filed on Dec. 3, 2020 and titled "VESSEL DRIVING SYSTEM AND ASSEMBLY", the entire content of both of which are incorporated herein by reference.

TECHNICAL FIELD

The present disclosure generally relates to marine vessels and more particularly to the field of outboard jet systems and corresponding assembly for propelling vessels.

BACKGROUND

Various driving mechanisms and systems have been utilized for propelling boats and other types of marine vessels including outboard motors and waterjets. An outboard motor is a self-contained propulsion system with motor and propeller packed into one unit, which can be conveniently bolted to the back of a boat making installation quick and simple. Because an outboard motor uses a propeller, the propeller has to be vertically positioned so as to be beneath the lowest part of a vessel to which the outboard motor is mounted and be able to operate in undisturbed water.

Waterjets are designed differently compared to outboard motors and have an inlet duct for directing water into a pump chamber. The inlet duct does not protrude from the bottom of the vessel on which a waterjet system is installed thus enabling the vessel to manoeuvre and operate in shallow waters.

SUMMARY

In one aspect, a vessel propelling system includes a motor and a waterjet system. The waterjet system is coupled to the motor and includes a stator with a plurality of blades. A first blade of the plurality of blades has a shape that is different than remaining blades of the plurality of blades, the shape of the first blade allowing a driving mechanism of the motor to pass through to be coupled to a shaft within the waterjet system.

In another aspect, the first blade has a length and a thickness that are relatively larger compared to a corresponding length and a corresponding thickness of the remaining blades of the plurality of blades.

In another aspect, a second blade of the plurality of blades has a length that is smaller than the length of the first blade but is relatively longer compared to a corresponding length of a subset of the remaining blades of the plurality of blades.

In another aspect, blades of the subset of the remaining blades are of the same shape and size.

In another aspect, corresponding lengths or and corresponding thicknesses of the first blade, the second blade and the subset of the blades are configured to straighten a flow of incoming water before exiting a channel of the stator.

In another aspect, the driving mechanism is a belt-driven mechanism, whereby a belt is vertically extending from the motor through a blade of the stator and is connected to a shaft of an impeller of the waterjet system.

In another aspect, the driving mechanism is a gear-based mechanism configured to couple a vertical shaft extending from the motor with a shaft in the waterjet system, thereby causing rotational movement of an impeller of the waterjet system.

In another aspect, a hull adaptor is configured to couple the vessel propelling system to an inlet duct formed in a vessel, the vessel propelling system configured to propel the vessel.

In another aspect, the inlet duct is formed into a recess in an aft of a hull of the vessel.

In another aspect, the inlet duct is fitted into an opening of a pod attached to a rear of the vessel.

In another aspect, the pod is configured to allow attaching the vessel propelling system to a hull of a vessel without a recess for the inlet duct.

In another aspect, the hull adaptor is coupled to the vessel propelling system using a sealing system.

In another aspect, the vessel propelling system is coupled to the vessel about a pivot allowing the vessel propelling system to be decoupled from an inlet duct of the vessel and lifted out of the water.

In another aspect, the waterjet system includes a steering nozzle for controlling a direction of a movement of a vessel to which the vessel propelling system is attached.

In another aspect, the steering nozzle is configured to be controlled by an actuating system attached to the vessel propelling system.

In another aspect, the waterjet system is configured to attach to the motor at an angle to accommodate for a shorter horizontal length of an inlet of the waterjet system when the vessel propelling system is installed to a vessel.

BRIEF DESCRIPTION OF THE DRAWINGS

The various advantages and features of the present technology will become apparent by reference to specific implementations illustrated in the appended drawings. A person of ordinary skill in the art will understand that these drawings only show some examples of the present technology and would not limit the scope of the present technology to these examples. Furthermore, the skilled artisan will appreciate the principles of the present technology as described and explained with additional specificity and detail through the use of the accompanying drawings in which.

DETAILED DESCRIPTION

Figure 1A:
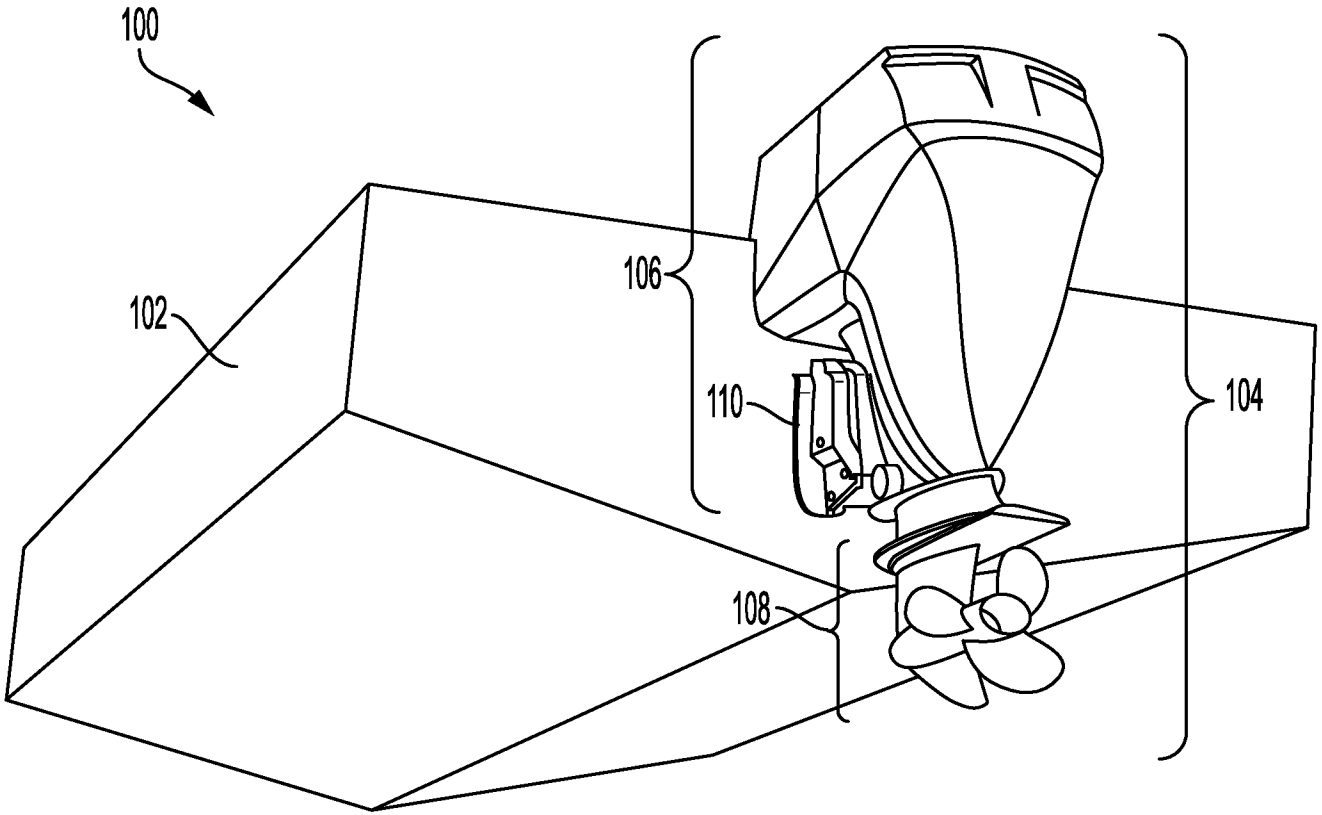
FIGS. 1A-E illustrate example configurations of a hull of a vessel including example vessel propelling systems, according to some aspects of the present disclosure.

Various examples of the present technology are discussed in detail below. While specific implementations are discussed, it should be understood that this is done for illustration purposes only. A person skilled in the relevant art will recognize that other components and configurations may be used without parting from the spirit and scope of the present technology. In some instances, well-known structures and devices are shown in block diagram form in order to facilitate describing one or more aspects. Further, it is to be understood that functionality that is described as being carried out by certain system components may be performed by more or fewer components than shown.

In the following description, certain specific details are set forth in order to provide a thorough understanding of various disclosed embodiments. However, one skilled in the relevant art will recognize that embodiments may be practiced without one or more of these specific details, or with other methods, components, materials, etc.

Unless the context indicates otherwise, throughout the specification and claims which follow, the word "comprise" and variations thereof, such as, "comprises" and "comprising" are to be construed in an open, inclusive sense that is as "including, but not limited to." Further, the terms "first," "second," and similar indicators of the sequence are to be construed as interchangeable unless the context clearly dictates otherwise.

Reference throughout this specification to "one embodiment" or "an embodiment" means that a particular feature, structure or characteristic described in connection with the embodiment is included in at least one embodiment. Thus, the appearances of the phrases "in one embodiment" or "in an embodiment" in various places throughout this specification are not necessarily all referring to the same embodiment. Furthermore, the particular features, structures, or characteristics may be combined in any suitable manner in one or more embodiments.

As used in this specification and the appended claims, the singular forms "a," "an," and "the" include plural referents unless the content clearly dictates otherwise. It should also be noted that the term "or" is generally employed in its broadest sense, that is, as meaning "and/or" unless the content clearly dictates otherwise.

In the present disclosure, a watercraft described herein can include an outboard motor or an outboard jet capable of being mounted to the watercraft. An outboard motor, as described in more detail below can include an upper portion and a lower portion. The upper portion can include a motor (e.g., similar to a motor of known or to be developed outboard motors) and the lower portion can include a configured waterjet.

As provided throughout the specification, the term "hull" as used herein means the body or frame of a watercraft (e.g., a vessel, a boat, a ship, a wave runner, a jet ski, a kayak, a canoe, etc.). The hull may be made into any shape and/or made of any type of known or to be developed material so long as it is buoyant and capable of supporting a propelling system such as an outboard jet of the present disclosure. In some examples, the hull can have a bow and a stern. In some examples, the hull may be fully enclosable and appropriately configured to safely accommodate passengers and/or equipment in a variety of conditions. Windows may be provided in the hull to allow the operator controlling the watercraft to steer it by visual guidance. As used herein, the term "bow" can mean the front portion of the watercraft (e.g., the forward section of the watercraft, the portion of the watercraft opposite the stern of the watercraft, etc.) and the term "stern" means the rear portion of the watercraft (e.g., the rear or aft sections of the watercraft, the portion of the watercraft opposite the bow, etc.). As used herein, the term "transom" means the portion of the watercraft where the hull terminates (e.g., the section of the watercraft where the stern terminates, etc.). Likewise, the terms "forward" and/or "forward section(s)" means approximately the front ⅓ of the watercraft's hull as measured from the bow. The terms "midship" and/or "amidship" means approximately the middle and/or second ⅓ of the watercraft's hull as measured from the bow. The terms "stern", "rear", "rear section(s)", "rear portion(s)", "aft", or "aft section(s)" refers to approximately the rearmost ⅓ of the watercraft's hull as measured from the bow.

As provided herein, the hull has a bottom (underside) surface and may be in any shape so long as the hull is capable of supporting at least one outboard jet. Non-limiting examples of shapes suitable for the bottom surface of the hull include, formed, round-bilged, soft-chined, chined, hard-chined, or any other variation such as a semi-round-bilge, S-curve, V-bottom, multi-bottom, flat (i.e., two-chined) and soon. As used herein the terms "chine(s)" and/or "chined" can mean an angle in the hull (c.f., rounded bottoms). Hard chines indicate angle with little rounding whereas soft chines are rounded but involve the meeting of distinct planes.

In some examples, the bottom surface of the hull can be a two-chine hull or a three-chine hull. The hull may be either a hard chine or soft chine hull. In one aspect, the hull is a two-chine (flat bottom) hull. In another aspect the hull is a three-chine hull.

FIGS. 1A-E illustrate example configurations of a hull of a vessel including example vessel propelling systems, according to some aspects of the present disclosure.

FIG. 1A illustrates a vessel 100. Vessel 100 can be any type of known or to be developed marine vehicle including a boat, a speed boat, etc., built and used for recreational, civilian, and/or military applications. Vessel 100 can include a hull 102 and an outboard motor 104. The outboard motor 104 can be comprised of an upper portion 106 (motor 106) and a lower portion 108 (propeller 108). Outboard motor 104 may be coupled (attached/bolted) to hull 102 using a coupling mechanism 110.

Figure 1B:
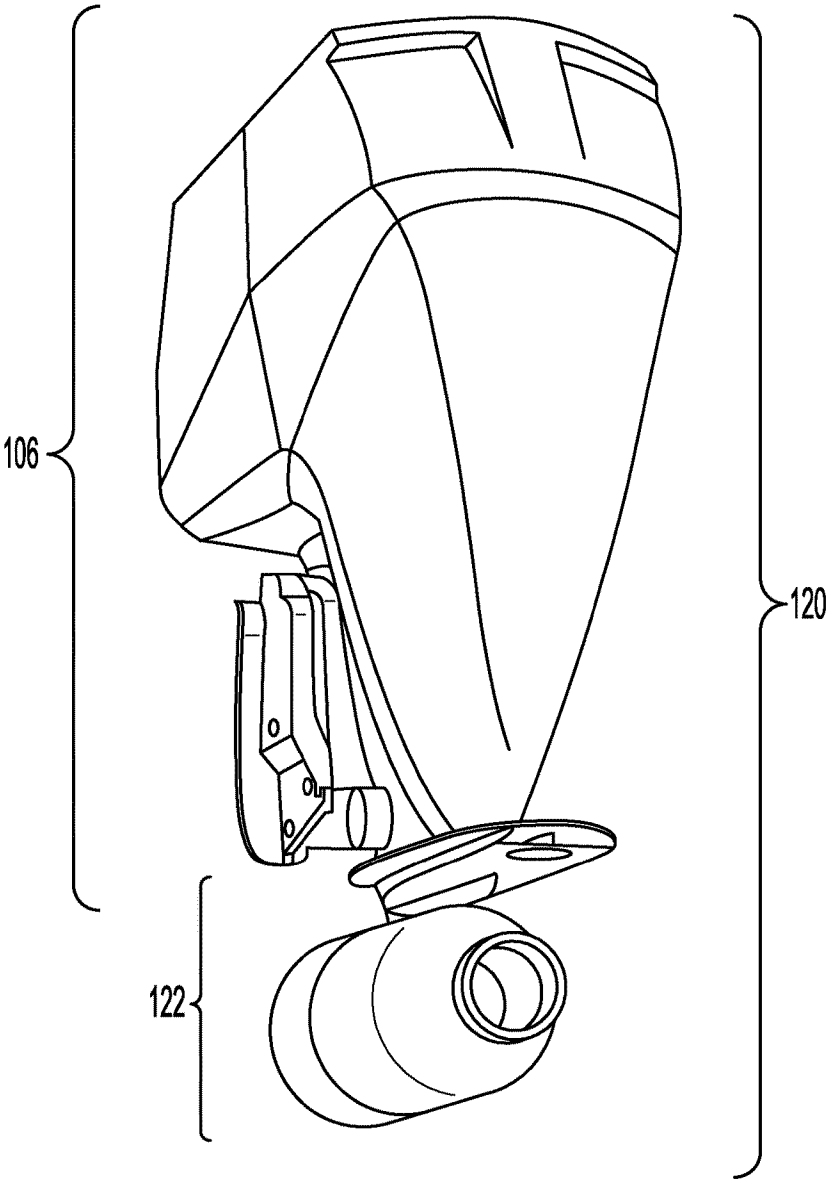

FIG. 1B illustrates an outboard jet 120. Outboard jet 120 (vessel propelling system or simply a propelling system) is a modified version of outboard motor 104 where the propeller 108 is replaced with waterjet (waterjet system) 122. Accordingly, outboard jet 120 is formed of motor 106 and waterjet 122. An outboard jet 120 may also be referred to as an outboard waterjet.

Figure 1C:
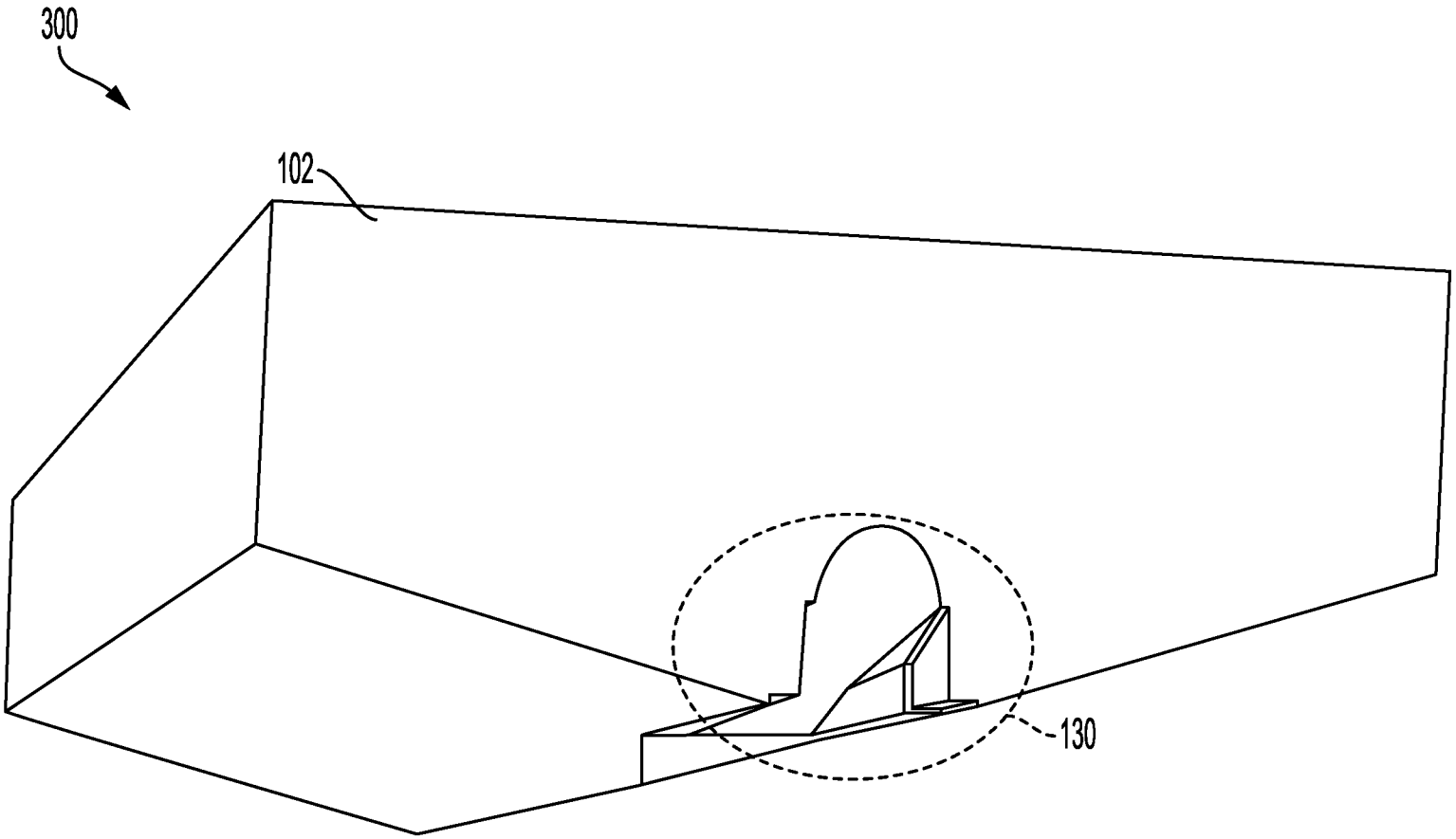

FIG. 1C illustrates a modification to hull 102 for installing outboard jet 120 to hull 102. As shown, an outer area 130 in the aft of hull 102 may be carved/formed to include a recess in which part of an inlet duct of waterjet 122 may be fitted. Various components of waterjet 122 including inlet duct thereof are described in more detail below.

Figure 1D:
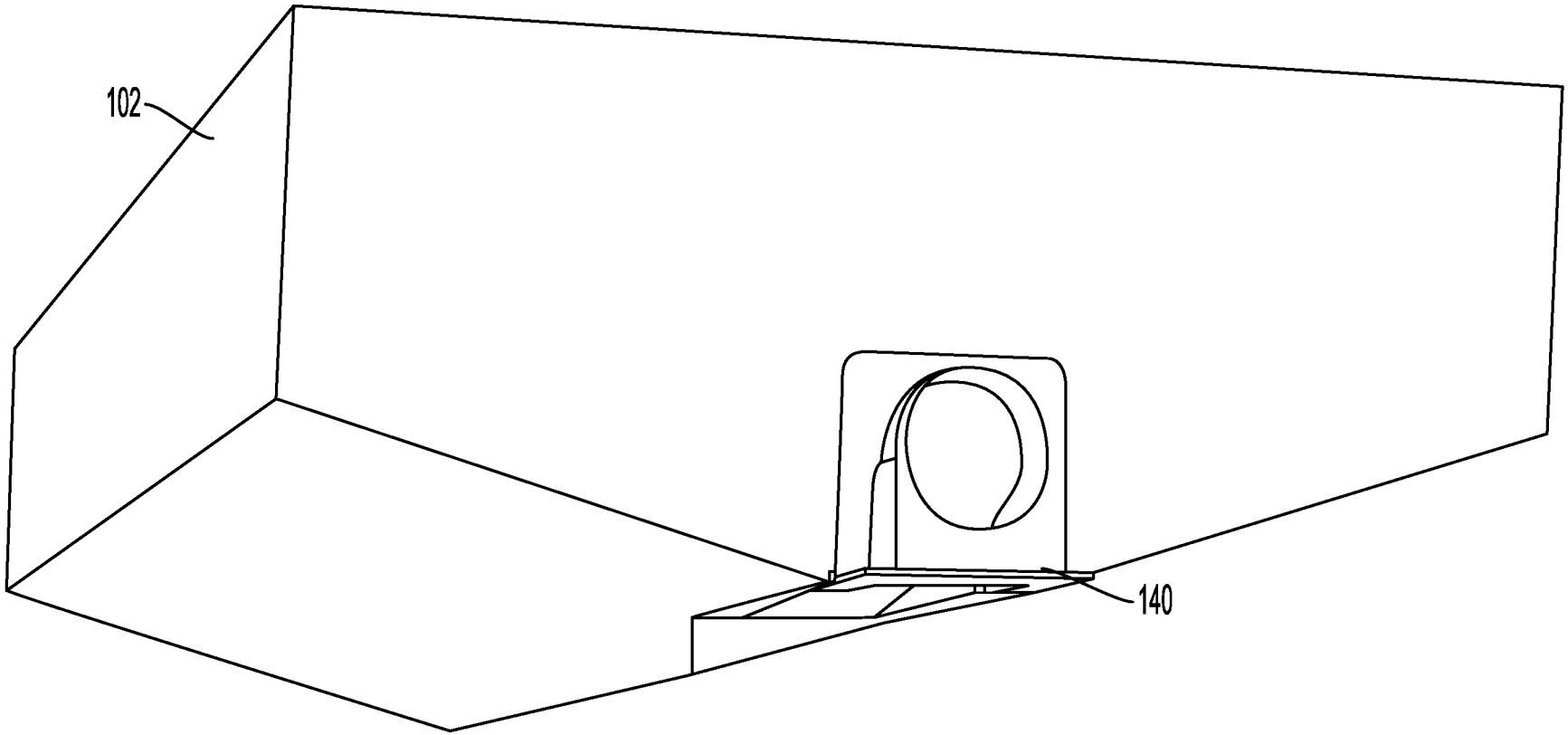

FIG. 1D illustrates a transition piece (transition component) 140 against which waterjet 122 can fit and thus be coupled to hull 102 for intake of water through an inlet and creation of necessary thrust for moving vessel 100. An inlet duct may be formed of recess 130 and transition piece 140. In one example, the use of the transitional piece may be optional and thus inlet duct can be formed of recess 130 alone. This transition piece 140 may also be referred to as a hull adaptor, which will be described in more detail below with reference to FIGS. 7A-B.

Figure 1E:
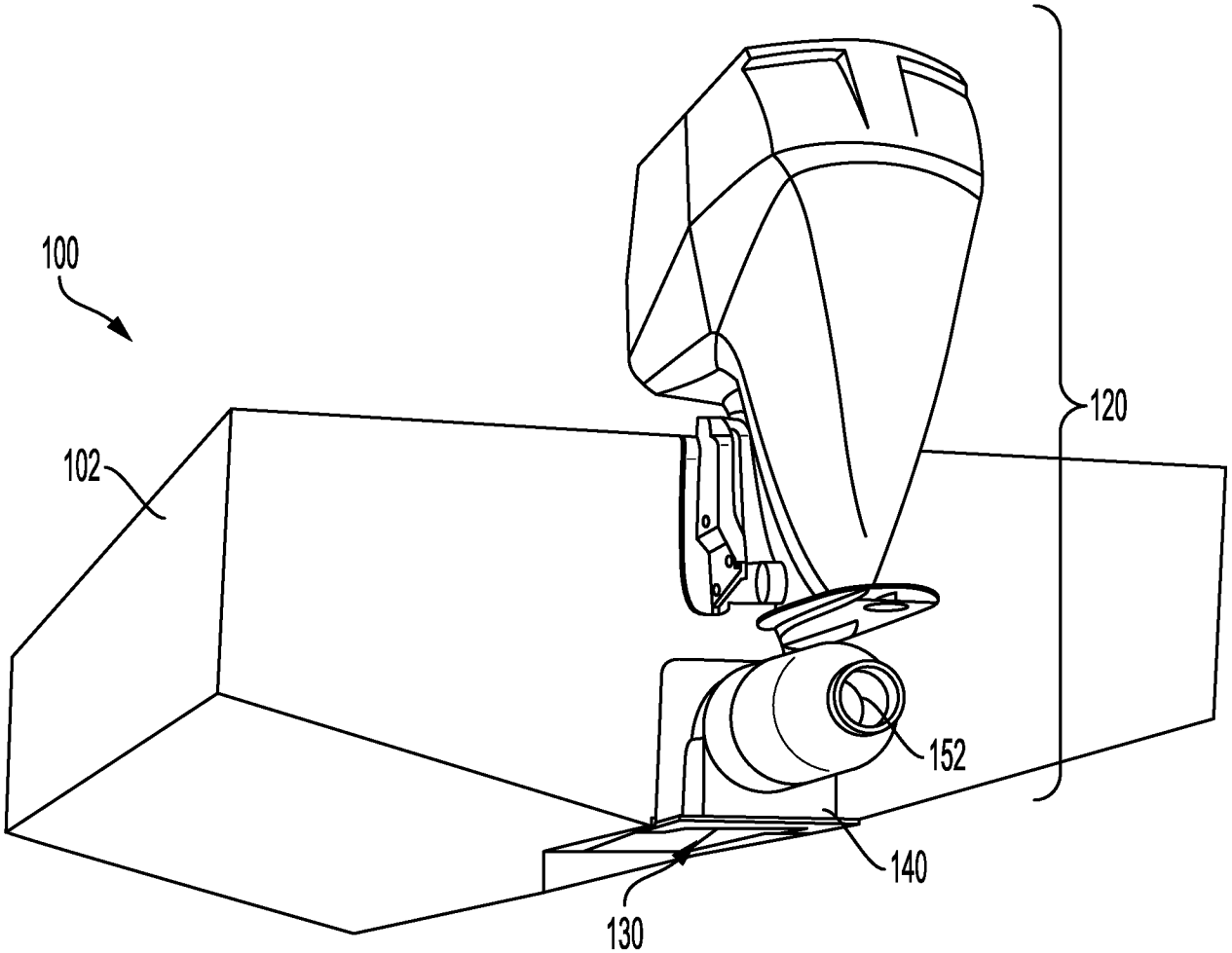

FIG. 1E illustrates a vessel 100 equipped/fitted with outboard jet 120, where waterjet 122 is coupled to aft of hull 102 via transition piece 140. Once operational, water can flow into inlet duct of waterjet 122 formed of recess 130 and transition piece 140 at the bottom of hull 102, which can then be forced out (discharged) via outlet 152 at high velocity to generate thrust for moving vessel 100 forward, backward, etc.

While FIGS. 1A-E illustrate fitting a single outboard jet 120 onto hull 102 of a vessel, the present disclosure is not limited thereto. For example, hull 102 may be fitted with two outboard jets 120, three outboard jets 120, etc.

Figure 2A:
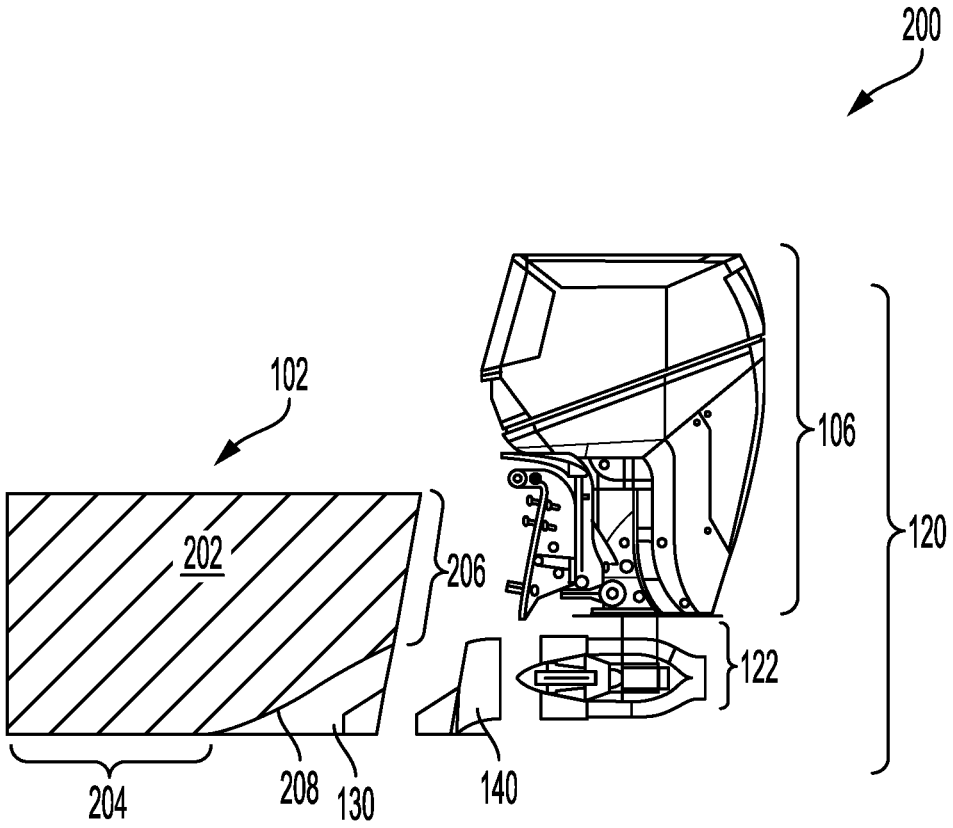
FIGS. 2A-C illustrate configurations of an outboard jet installed on a vessel, according to some aspects of the present disclosure.
Figure 2B:
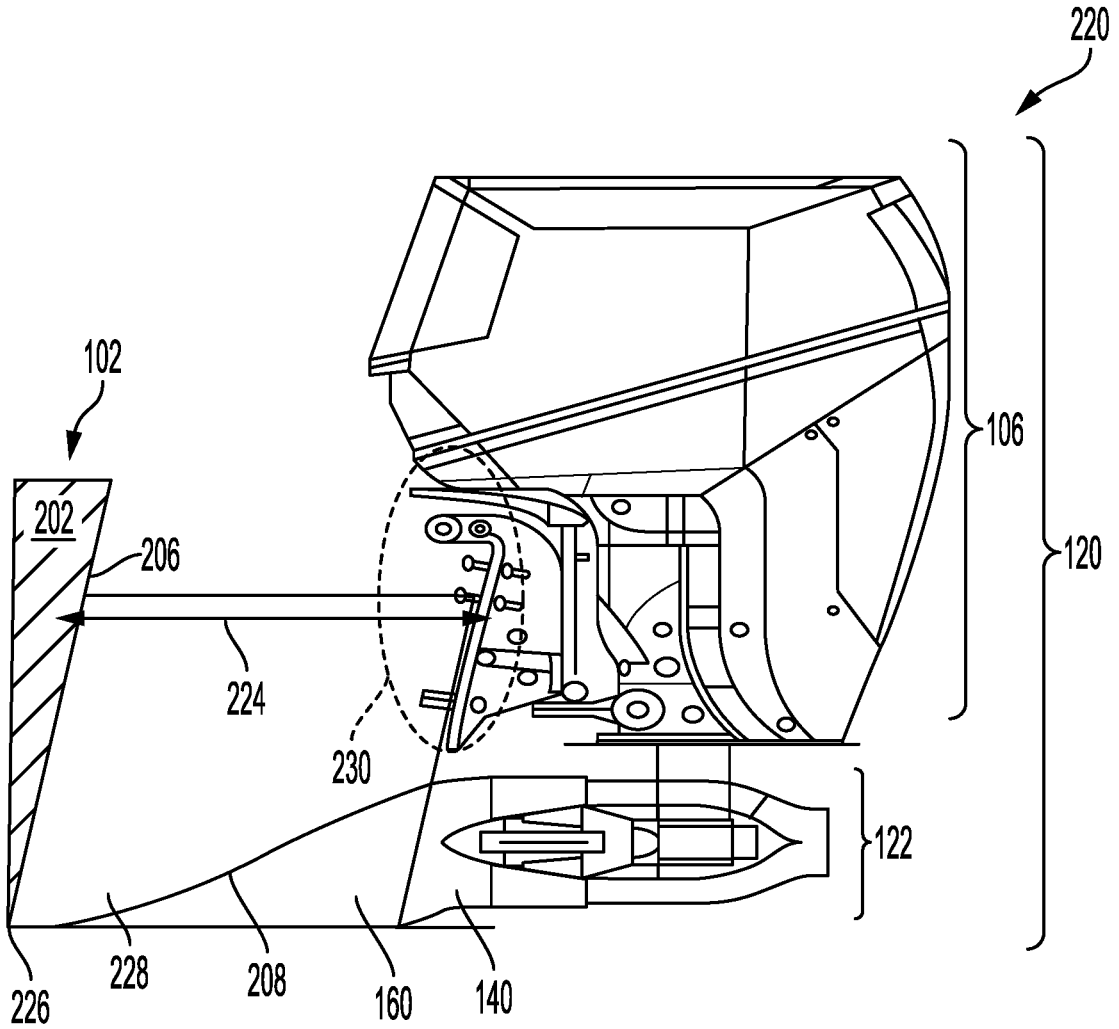
Figure 2C:
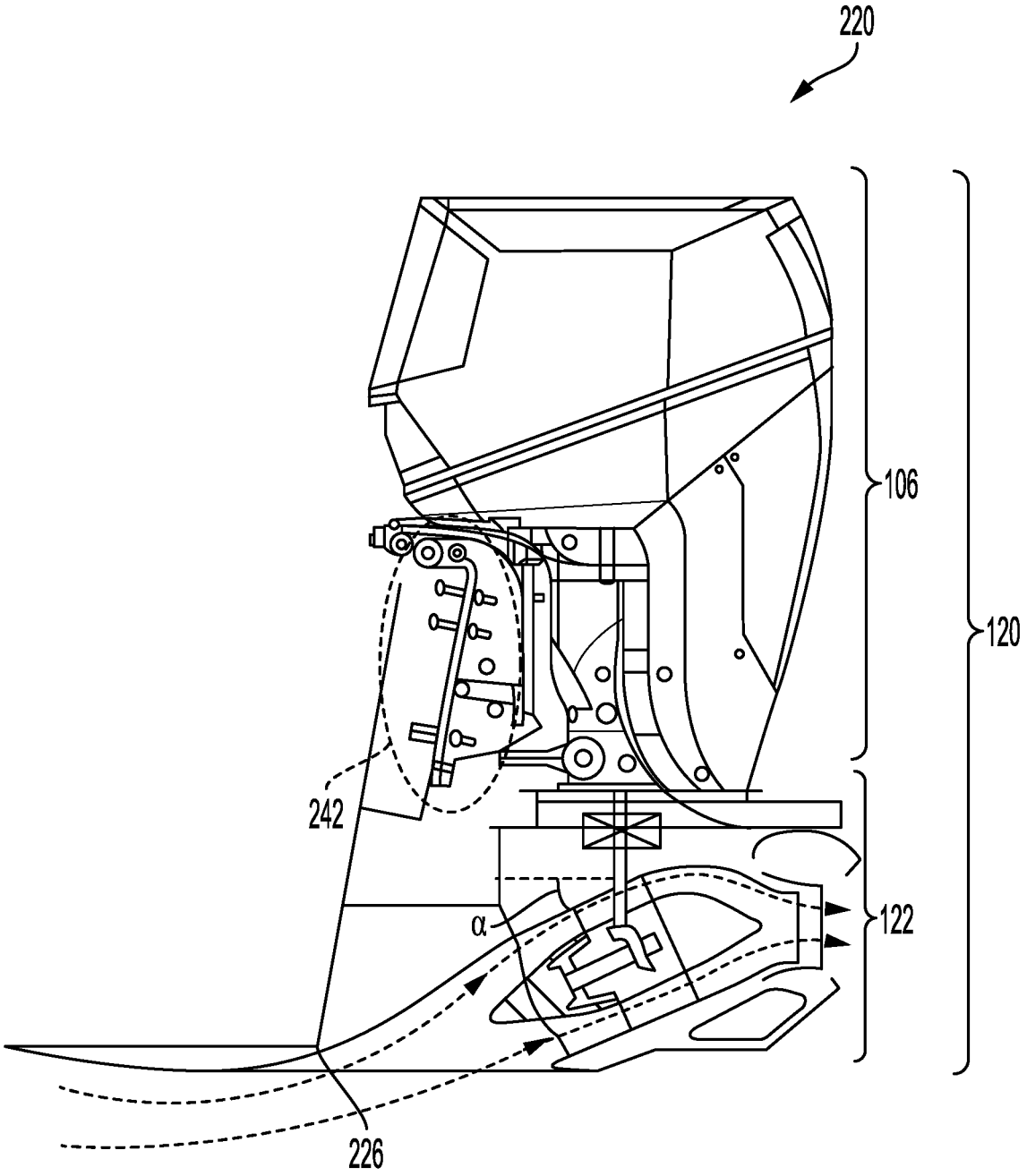

FIGS. 2A-C illustrate configurations of an outboard jet installed on a vessel, according to some aspects of the present disclosure. Each one of FIGS. 2A-C illustrate a different configuration for installing the outboard jet 120 on the hull 102 of vessel 100. In one instance (FIG. 2A), hull 102 is a newly built hull and hence configured to include an area 130 with a recess 130 for inlet duct of waterjet 122 as described above with reference to FIG. 1C (This may be referred to as the in-built configuration). In another instance, (FIGS. 2B and 2C), an existing vessel or hull 102 is retrofitted with outboard jet 120, where hull 102 does not have such specially formed recess area in the aft of hull 102 to be used for inlet duct of waterjet 122 (pod configuration).

FIG. 2A is a side view 200 of the in-built configuration, also described above with reference to FIGS. 1A-E. As can be seen from FIG. 2A, an inside area 202 towards the back of hull 102 is shown formed of bottom 204 of hull 102, transom 206 of hull 102 and an angled surface 208 caused by a recessed area 130 formed on the external surface of hull 102 as described above with reference to FIG. 1C. As noted above, formed recessed area 130 creates a cavity for inlet duct of waterjet 122. FIG. 2A also shows a side view of transition piece 140 described above with reference to FIG. 1D as well as a side view of outboard jet 120 including upper portion (motor) 106 and lower portion (waterjet 122) thereof.

FIG. 2B illustrates a side view 220 of pod configuration with outboard jet 120 installed on hull 102 and waterjet 122 fitted into transitional piece 140. A horizontal distance 224 indicates a distance by which inlet duct protrudes aft of transom 206 for hulls that do not have specially formed recess at the bottom for an inlet duct, as described above with reference to FIGS. 1A-E and 2A.

This horizontal length poses a challenge for the pod configuration where a recess formed on an external surface of hull 102, as in the in-built configuration, does not exist. Installing an outboard jet 120 onto an vessel with no recessed area 130 formed to accommodate an inlet duct of waterjet 122 poses a challenge because the inlet duct exists as an external extension aft of transom 206 and thus can extend as an additional length (e.g., equal to horizontal distance 224) beyond the tip 226 of hull 102. Tip 226 may be defined as a point where bottom surface 204 and transom 206 intersect to form a bottom corner of hull 102 when no special forming of hull 102 exists for accommodating an inlet duct.

In some examples, fitting of existing outboard motors to hulls in pod configurations can be achieved by installing a pod or pods to the hull (e.g., back of hull 102) on which outboard motors would then sit, thus providing support for the outboard motor while placing the outboard motor in reasonable proximity of transom 206. Pod 228 coupled to after of hull 102, as shown in FIG. 2B, is a non-limiting example of such pods.

As shown in FIG. 2B and when pod 228 is used, outboard jet 120 is coupled to pod 228 at 230, with pod 228 attached to hull 102 (e.g., attached to transom 206 and/or bottom of hull 102) via any known or to be developed mechanism and/or material for coupling pod 228 to hull 102. As further shown in FIG. 2B, inlet duct is formed in pod 228 and is comprised of a recess 160 formed in pod 228 (similar to recess 130) and transition piece 140 (which can illustrate how pods such as pod 228 is to be designed and built to match the length of an inlet duct thus adding to manufacturing and installation complexities and costs for mounting and installing outboard jet 120 onto hull 102). Distance 224 can be, for example, 600 mm or any other horizontal length corresponding to the length of an inlet duct that can be determined based on experiments and configuration specific measurements for different systems and different vessel applications.

Pod 228 can also be made of any known or to be developed suitable material including aluminum, fiberglass, etc. As described above, an inlet duct can be carved out within Pod 228 and can be made from any known or to be developed suitable materials including plastics such as HDPE that are more cost efficient.

While examples of installing outboard jet 120 to hull 102 using a formed recess 130 for inlet duct (for in-built configuration) and using pod 228 with a similarly formed recess 160 (for pod configuration) are described above, the present disclosure is not limited thereto. For example, in some configurations, a hull may be modified to include a recess for inlet duct in a similar manner as described above for the in-built configuration. Similarly, a pod may be attached to a newly built hull for coupling outboard jet 120 thereto in a similar manner as described above for the pod configuration.

FIG. 2C illustrates a side view 240 of another example of a pod configuration where outboard jet 120 is installed on hull 102 using coupling mechanism 242 without use of specially built pods (e.g., such as pod 228 shown in FIG. 2B) to enable horizontal extension of the inlet duct equal to horizontal distance 224 from tip 226, as described above. Instead and as shown in FIG. 2C, waterjet 122 may be coupled to motor 106 at an angle $\alpha$ in order to reduce the horizontal length extension from tip 226 to be within the length of standard pods currently used for installing outboard motors onto vessels. The angled coupling of waterjet 122 to motor 106 and the use of existing/standard pods, reduce complexity and increase ease and efficiency of installing and retrofitting hulls with outboard jet 120. FIG. 2C illustrates the flow of water through inlet duct (e.g., formed of recess 160 and transition piece 140, as described above). Example configuration of FIG. 2C may be used with waterjet system utilizing a bevel gear-based mechanism, which will be further described below.

In some examples, angle $\alpha$ can be determined based on experiments and/or empirical studies. In another example, for outboard jet 120, angle $\alpha$ can be adjustable for different types and models of hulls.

In some example, motor 106 of outboard jet 120 described with reference to FIGS. 1A-E and FIGS. 2A-C, can transfer engine power to impeller of waterjet 122 via one of two mechanisms. One such mechanism is a bevel gear-based mechanism, and another is a belt driven mechanism. Both these example mechanisms will be further described below with reference to FIGS. 4A-D. Motor 106 can operate on fossil fuels (e.g., diesel), can be an electric motor operating on any type of known or to be developed suitable battery system, or can operate using any known or to be developed system utilizing a renewable energy source. While a bevel gear-based mechanism is referenced throughout the present disclosure as a non-limiting example, any other type of known or to be developed gear-based system can also be used and is within the scope of the present disclosure.

A conventional waterjet system (inboard waterjet system) is arranged with a fore and aft shaft that extends forward through the inlet ducting and into the vessel in which the waterjet system is installed. Such shaft manifests as a coupling that the main motor would be connected to for transmitting power there through. The motor and the inlet ducting are arranged horizontally and in line with one another. In this scenario the motor has to be forward of the waterjet and within the hull (inboard).

Unlike conventional inboard waterjet system, in the case of the outboard jet 120, motor 106 is located above waterjet 122. Positioning waterjet 122 relative to motor 106 to stay with a configuration similar to inboard waterjet systems, results in inlet duct and motor 106 having to be located a substantial distance aft of hull 102 and the outboard motor. This would in turn result in a non-functioning arrangement. To address this deficiency, an alternative drive arrangement is proposed.

Figure 3A:
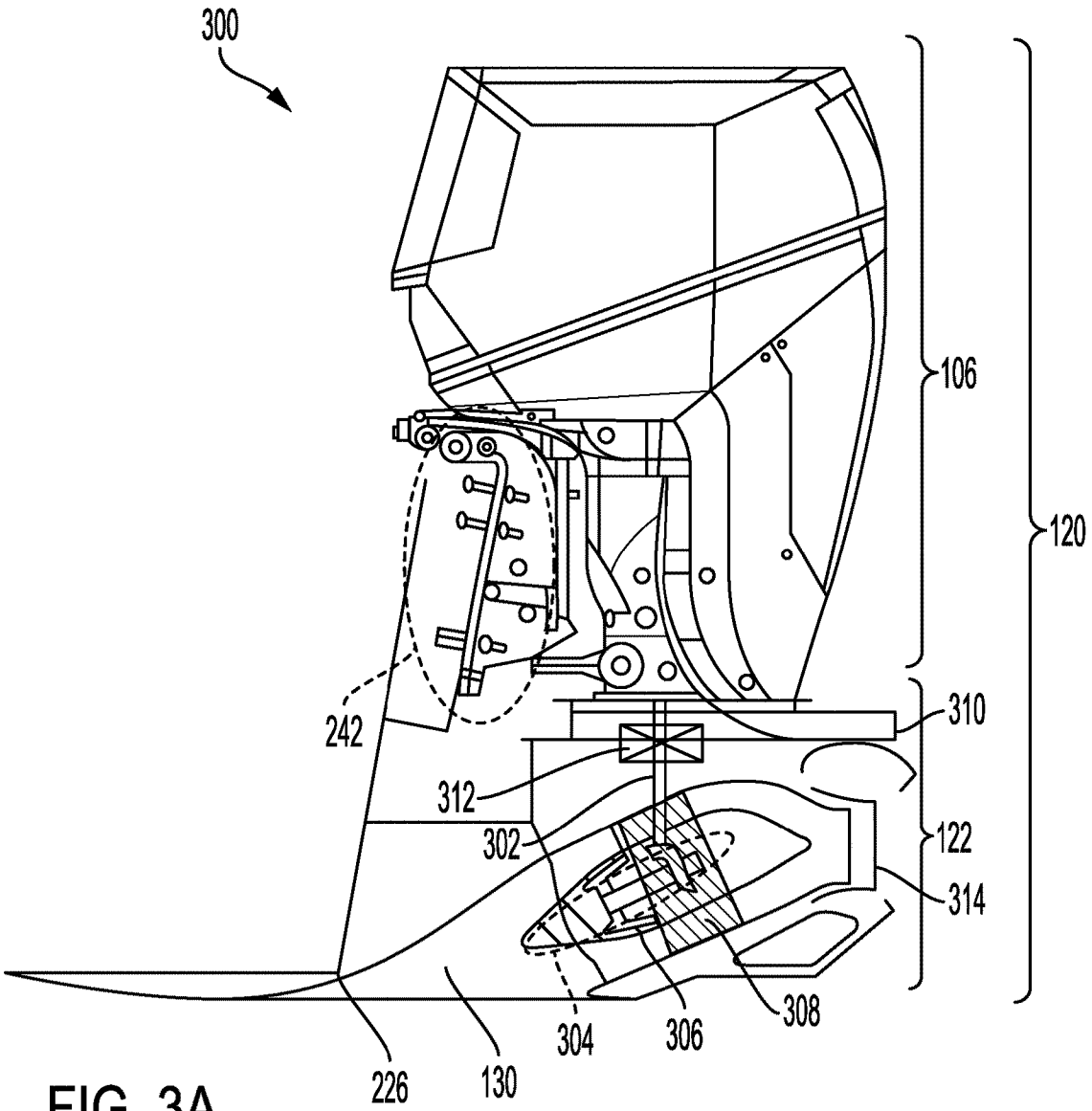
FIGS. 3A-C illustrate examples and components of the outboard jet, according to some aspects of the present disclosure.
Figure 3B:
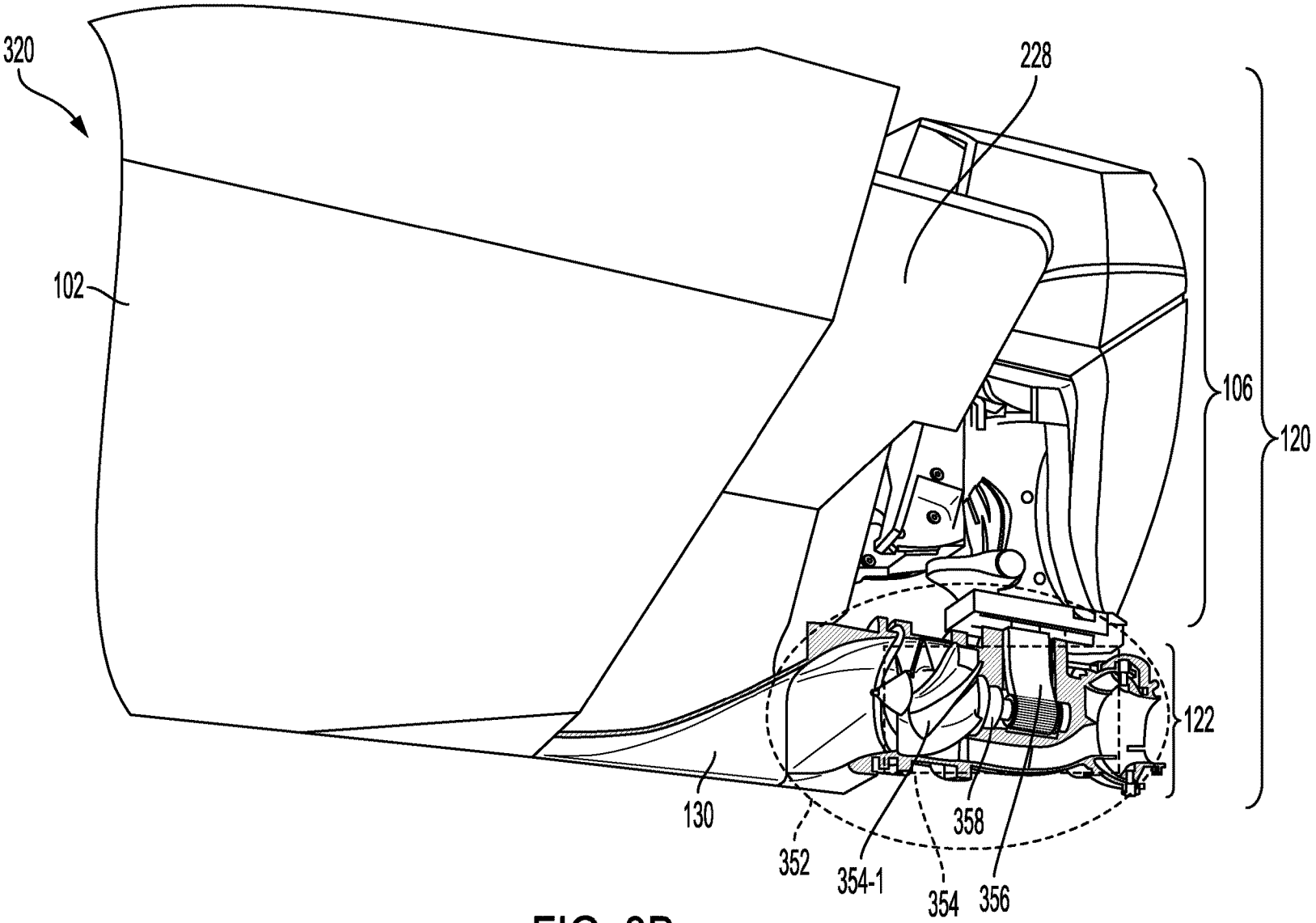
Figure 3C:
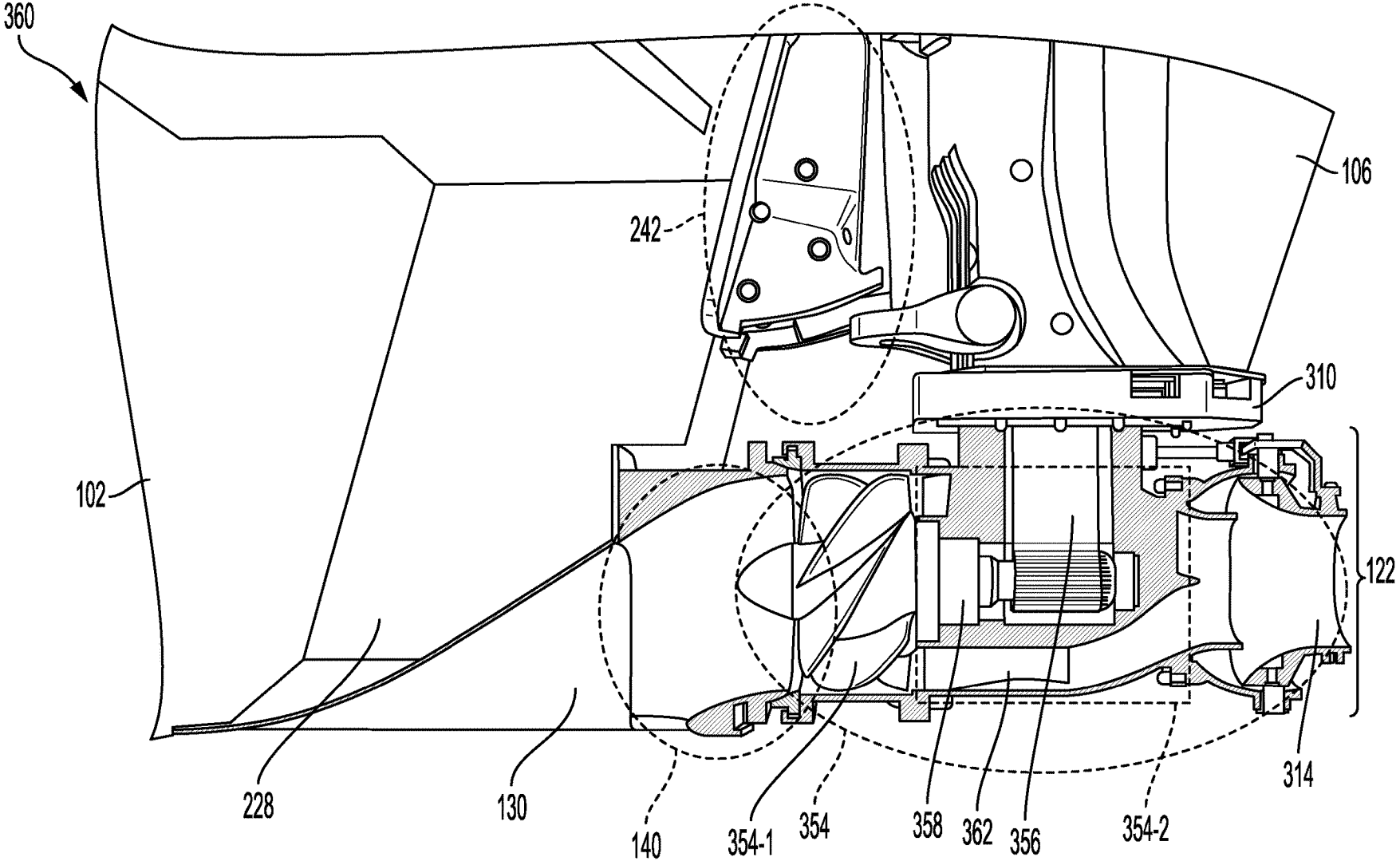

FIGS. 3A-C illustrate examples and components of the outboard jet, according to some aspects of the present disclosure.

As shown in FIG. 3A, configuration 300 illustrates that motor 106 of outboard jet 120 has a driveshaft (a vertical crankshaft) 302 extending therefrom and coupled to waterjet 122 using bevel gear 304, which is then coupled to impeller 306 and can drive impeller 306 from behind as opposed to driving impeller 306 from the front as is the case with inboard waterjet systems. In one example, impeller 306 may be directly coupled to bevel gear 304 (angled bevel gear 304) to eliminate use of a shaft and/or a separate aft supporting bearing. One advantageous aspect of this configuration is that any flow disturbance caused by such shaft that ordinarily extends forward from an inlet cone of impeller 306 through the inlet duct is prevented when the use of the shaft is eliminated. This elimination in turn ensure optimal flow and hence performance of waterjet 122.

FIG. 3A also illustrates an envelope (box) 312 for a clutch system of motor 106 and an exhaust 310 of motor 106, which can function to engage/disengage motor 106 from waterjet 122. Such clutch system can have various degrees for the level of engagement/disengagement of motor 106 from waterjet 122 (i.e., gear reduction and/or increase). The use of gear reduction can provide the advantage of matching an impeller type to the engine power of motor 106. Driving waterjet 122 (via driveshaft 302 and bevel gear 304) through the discharge section 308 of the waterjet 122, which is a relatively high pressure region within waterjet 122, can provide an improved control and management of water flow around cavities required for shafting (or the belt system in the case of belt driven mechanism, which is described in more detail below).

Waterjet 122 can operate as a pump. As a pump, waterjet 122 has impeller 306 and a stator (examples of which are shown in FIGS. 4A-D). Impeller 306 is aligned with the direction and flow of water as shown in FIG. 3A. The stator can have stationary blades that are designed to capture and control the exit of water flow coming through the inlet duct. Through this discharge section 308 of the pump, water flow is accelerated to convert the pressure energy into high speed velocity as required for the thrust. Configuration 300 also shows a steering nozzle 314 that can move horizontally (e.g., out or into the sheet on which FIG. 3A is show) thus causing the vessel to which outboard jet 120 is mounted to be steered left and/or right. This will be further described below.

While FIG. 3A illustrates components of a bevel gear-based mechanism that can be utilized for outboard jet 120, FIG. 3B illustrates a belt driven mechanism as an alternative to a bevel gear-based mechanism for use in an outboard jet, according to some aspects of the present disclosure.

In configuration 320 of FIG. 3B, outboard jet 120 is attached to hull 102 via pod 228, all of which have been described above with reference to one or more of FIGS. 1A-E and FIGS. 2A-B and hence will not be further described for sake of brevity. Also, as described above, outboard jet 120 can be comprised of motor 106 and waterjet 122, which is fitted to (coupled to) the inlet duct via a transition piece such as transition piece 140 (a hull adaptor) described with reference to FIG. 1D.

FIG. 3B illustrates a cross-sectional view 352 of waterjet 122 that shows a number of inner components of waterjet 122 including a stator/impeller 354 (stator/impeller combination 354) formed of impeller 354-1 and a stator (partial/cross-sectional view of stator/impeller 354 is provided in FIG. 3B but more detailed example embodiments of stator/impeller 354 will be described below with reference to FIGS. 4A-D), a belt 356, and a shaft 358. Inner components of waterjet 122 shown via cross-sectional view 352 illustrate waterjet 122 utilizing a belt driven mechanism. Belt 356 and shaft 358 may be made of any known or to be developed suitable material. As shown, belt 356 can transfer the power generated by motor 106 to impeller 354-1 via shaft 358. In one example, belt 356 is perpendicular to shaft 358 and is coupled thereto via any known or to be developed mechanism or arrangement. As will be described below, belt 356 passes through stator portion of impeller/stator 354 to be coupled to shaft 358.

FIG. 3C illustrates a close-up view of a cross-sectional view of the waterjet component shown in FIG. 3B, according to some aspects of the present disclosure. As shown in FIG. 3B, impeller/stator 354 is comprised of impeller 354-1 and stator 354-2. In FIG. 3C, only a cross-sectional view of stator 354-2 is shown (a blade 362 of stator 354-2 is visible through this cross-sectional view of stator 354-2. In addition to a close-up view of cross-section 352 and components thereof, as described above with reference to FIG. 3B, configuration 360 also provides a close-up view of coupling mechanism 242 for coupling outboard jet 120 to hull 102 (installing outboard jet 120 on hull 102), as described above with reference to FIG. 2C. Configuration 360 also shows a close-up view of exhaust 310 described above with reference to FIG. 3A. FIG. 3C also illustrates a cross-sectional view of steering nozzle 314.

Figure 4A:
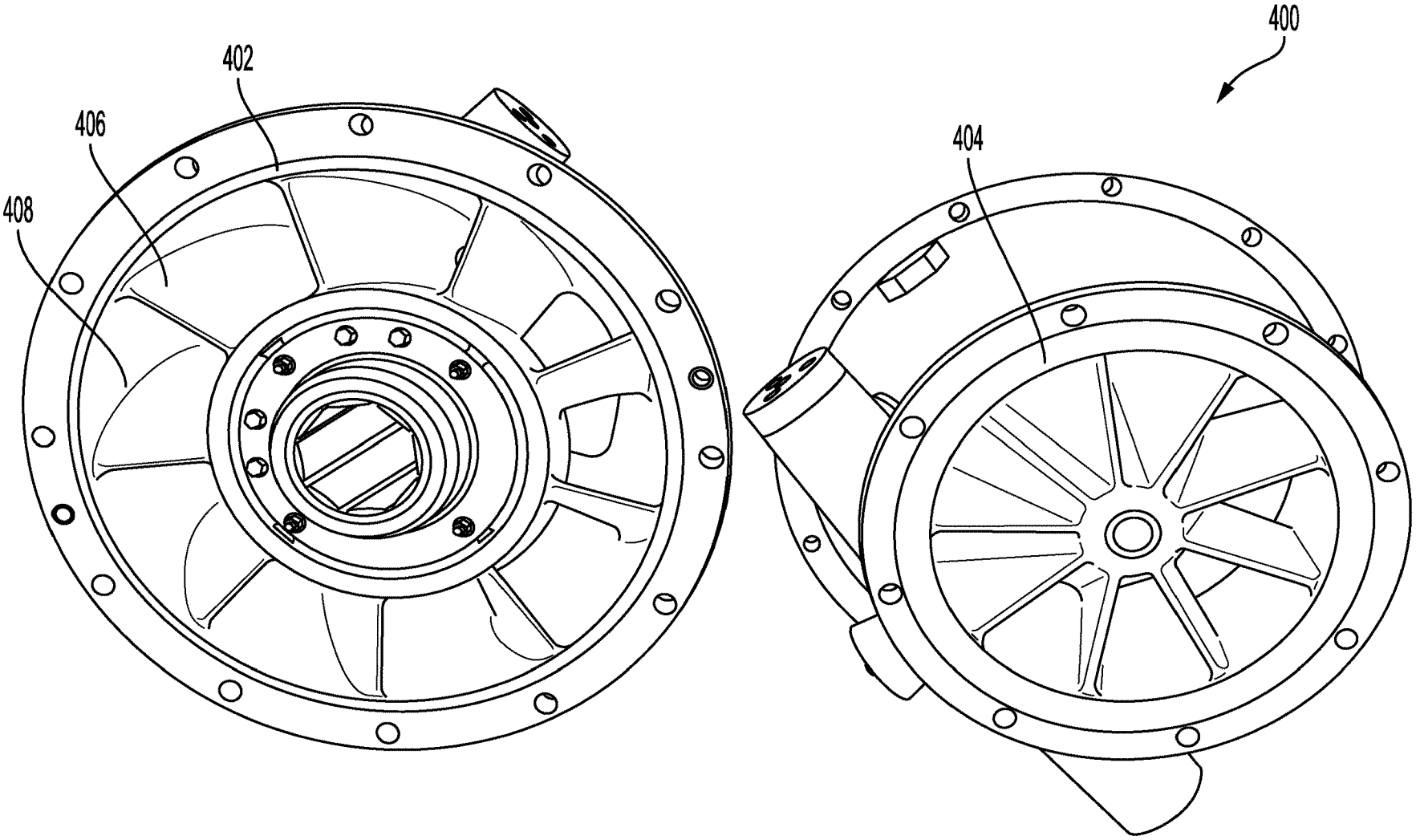
FIGS. 4A-D illustrate a number of different configurations of a stator used within a waterjet system of an outboard jet, according to some aspects of the present disclosure.

FIGS. 4A-D illustrate a number of different configurations of a stator used within a waterjet system of an outboard jet, according to some aspects of the present disclosure. FIG. 4A illustrates a conventional stator configuration, according to some aspects of the present disclosure. Stator 400 can have seven to nine (or alternatively any other number of) identically formed blades make up a stator. Stator 400 can have an inlet component 402 and an outlet component 404. Inlet component 402 has a relatively larger diameter than outlet component 404. In configuration of FIG. 4A, stator 400 has nine identical blades 406 evenly spaced (only one blade 406 is numbered in FIG. 4A for reference). Each blade has a typical foil section with leading edge shaped to best allow water flow to pass over without separation and a progressive blade thickness along the length of each blade 406. A flow channel 408 is also formed between any two blades 406 and is uniform in section area and volume.

While FIG. 4A illustrates a conventional stator configuration, in one or more examples of the present disclosure a modified stator is proposed to enable coupling of motor 106 to waterjet 122 using above described bevel-gear and belt-driven mechanisms.

In one or more example embodiments, a stator such as stator 354-2 of FIG. 3C can be configured so that at least one blade of a stator has a different shape. For example, one blade can be incorporate a wider section relative to other blades in order for driveshaft 302 to pass therethrough and be coupled to bevel gear 304 (or similarly for shaft 358 of a belt driven mechanism described with reference to FIGS. 3B and 3C, to pass through). The residual blades may then be separately managed/controlled to facilitate this either by having special individual shapes and/or uneven spacing to ensure that resulting fluid chambers are relatively consistent to allow water to freely flow therethrough. Therefore, modifying stator blades on the discharge side of waterjet 122 to couple the driveshaft 302 to bevel gear 304 (or shaft 358 of a belt driven mechanism) can optimize flow conformity to these blade shapes without loss of efficiency. In other words, one of the stator blades 406 may be designed to taper to a thicker mid blade section to create "space" to pass either driveshaft 302 (or the equivalent belt drive of a belt driven mechanism) through so as to avoid having the driveshaft 302 or the drive belt be in the water flow itself. By designing one of the blades 406 differently, other blades 406 would then have to be actively offset so as to maintain uniform flow properties for the water flow.

In this alternative stator design, an inlet of the stator may be similar to inlet 402 except that as we progress into any one of chamber 408, the blade shapes and spacing will be adjusted accordingly to provide for the thickening of the "drive" blade section whilst maintaining uniform flow properties adjacent. This will be further described below with reference to FIGS. 4B-D.

Figure 4B:
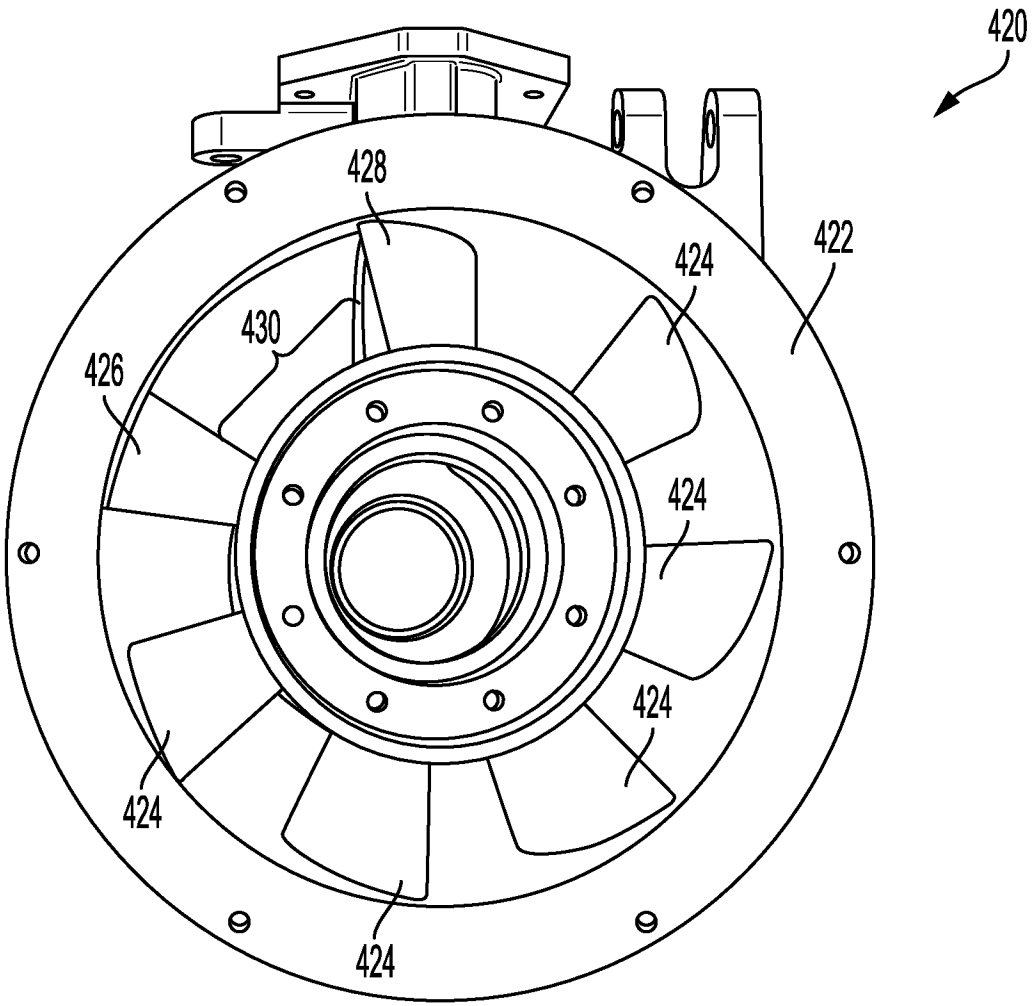

FIG. 4B illustrates another example design and configuration of a stator to be used in an outboard jet, according to some example embodiments. Example configuration 420 of an inlet component 422 of a stator (e.g., stator 354-2 of FIG. 3C) includes blades of varying shapes, lengths, and/or sizes. Configuration 420 shows a non-limiting example of three different types of blades that may be of different sizes, thickness, and/or shapes and spaced apart in a non-uniform fashion. The first type of blades are blades 424 that may be typical and standard blades such as blades 406 of FIG. 4A. Blades 424 may have the same shape, size, length, and/or width (thickness). The second type of blade is blade 426. In one example, blade 426 has a length and/or width that is relatively larger compared to corresponding lengths and/or widths of blades 424 but may be smaller than a corresponding length and/or width of blade 428. The third type of blade is blade 428 that is of different shape, thickness, and size relative to blades 424 and blade 426. For example, blade 428 can be thicker than blade 426 and/or any one of blades 424. Blade 428 can also have a longer length and/or larger width than corresponding lengths and widths of blades 424 and 426. Blade 428 can serve as a both a stator blade for the pump but also to a section that is sufficient to provide a cavity (through for the belt drive mechanism including belt 356 and shaft 302 to pass). Because of this design, the resulting chord "thickness" of blade 428 is more than a typical stator blade. Also, the length of blade 428 is longer compared to a typical stator blade as blade 428 should be tapered back to a thin section at an outlet (not shown in FIG. 4B but can be the same or similar to outlet component 404 of FIG. 4A) for the water to discharge. Blade 362 shown in cross-sectional view of stator 354-2 in FIG. 3C can be any of blades 424 described with reference to FIG. 4B.

When water enters stator 354, it will be guided by all seven blades 424, 426, and/or 428. At that point, it is effectively passing through longitudinal channels that are bound laterally on four sides (by inlet component 422 and a corresponding outlet component such as outlet component 404). The main purpose of these blades is to "straighten the flow", as it will be rotational as it leaves the impeller (e.g., impeller 354-1). When the flow is recombined (after the blades), the relative velocity of each chamber flow should be aligned, both in terms of speed and angular rational component. A chamber is formed of the space between every two of blades 424, 426, and/or 428. An example chamber is chamber 430 shown in FIG. 4B (FIG. 4B only illustrates one example chamber but there are 7 example chambers formed by blades 424, 426, and/or 428).

Figure 4C:
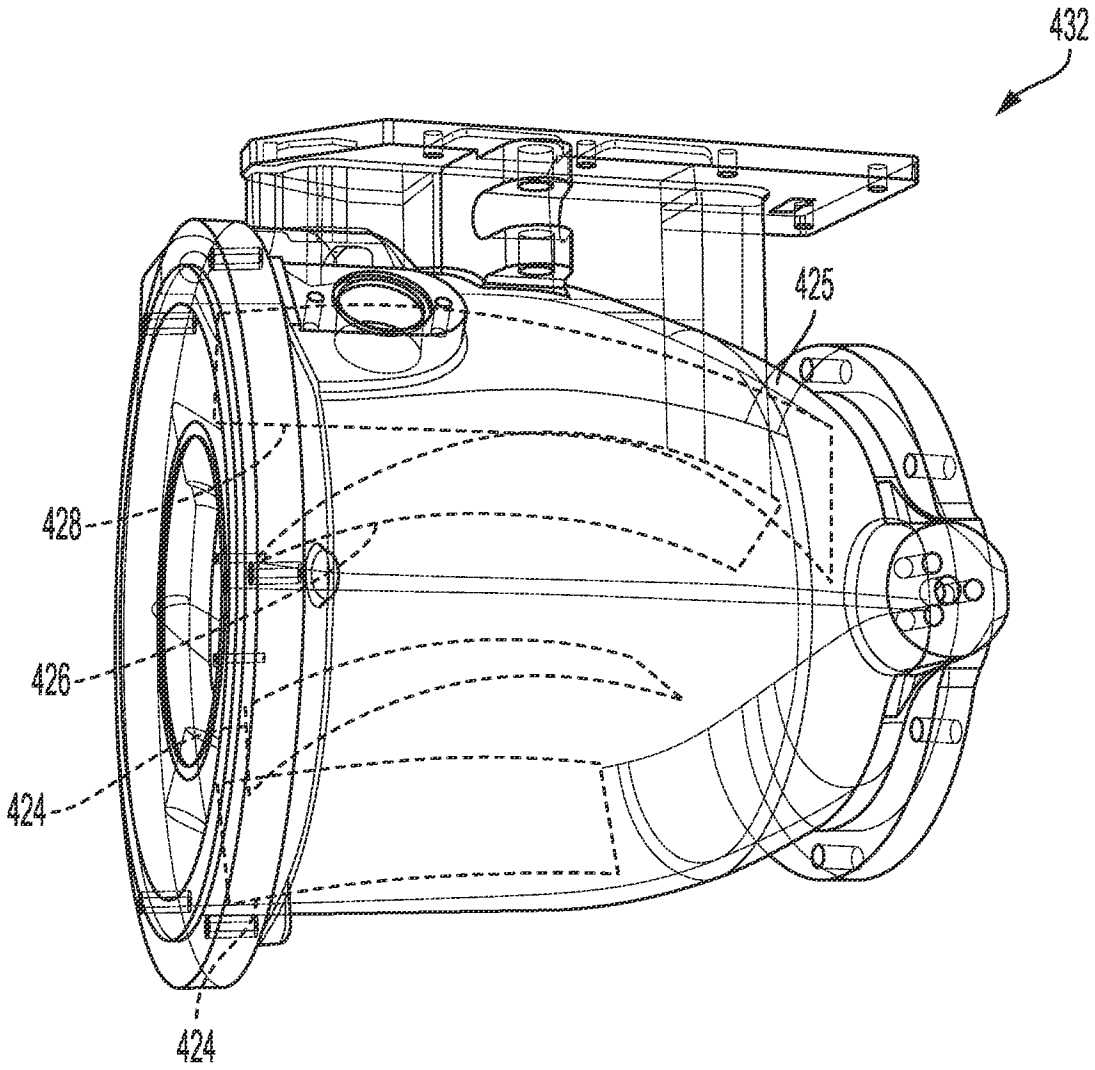
Figure 4D:
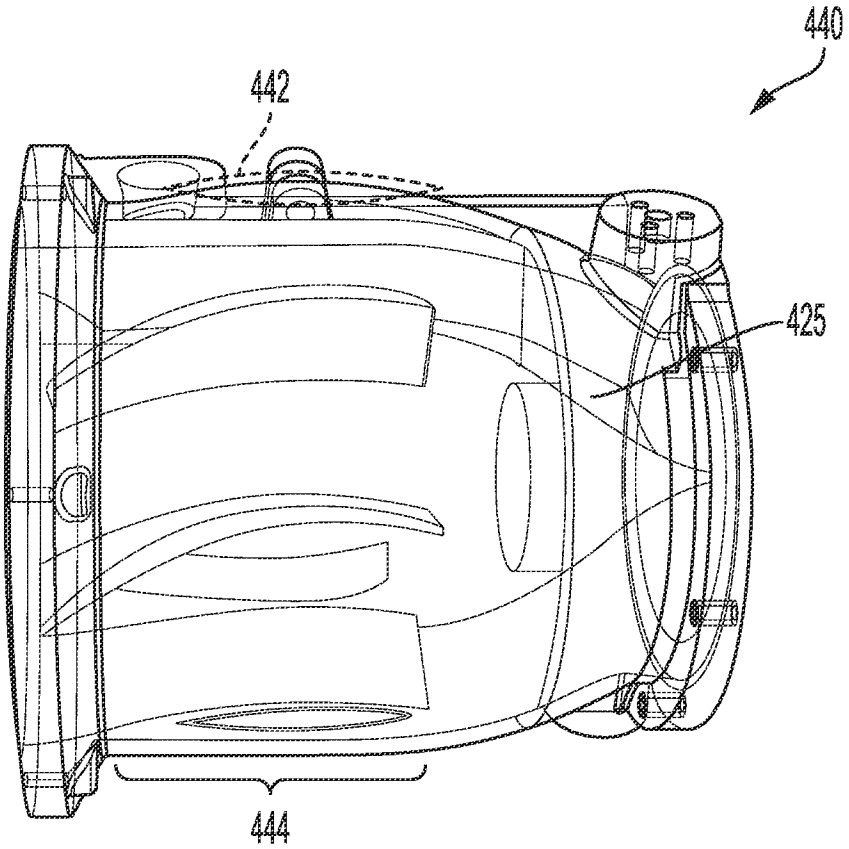

FIG. 4C illustrates inlet component 422 from another angle. Configuration 432 is a semi-transparent and side view of inlet component 422 that shows the shapes and configuration of four blades (two of blades 424, blade 426, and blade 428) inside the body of inlet component 422. As can be seen from FIG. 4C, while two blades 424 have the same shape and length, blade 426 and blade 428 both have different shapes and are of different length. Due to the thicker section of blade 428, the adjacent chamber sectional area is reduced, this would cause the flow to accelerate relative to the flow in the adjacent chamber, which is unwanted at this point. In order to mitigate this, as shown in configuration 440 of FIG. 4D, the volume of chamber 425 is adjusted radially with the upper portion 442 of chamber 425 having a convex shape (a bump at top) to increase volume to offset section growth of blade 428 while the bottom portion 444 of chamber 425 is longitudinally straight. To recombine chambers flow into a total flow, blades 426 and 428 are such that allow for a progressive return to same relative flow conditions as in the other channels and hence why blade 426 is longer than blade 428 and exists adjacent to blade 428.

As noted above, belt drive mechanism is an alternative to the bevel gear mechanism where instead of driveshaft 302 and bevel gear 304, a belt is coupled to motor 106 and waterjet 122 and facilitates transfer of power from motor 106 to waterjet 122.

As opposed to bevel gear set mechanism where waterjet 122 is tilted at an angle $\alpha$ for better coupling to hull 102 as described above with reference to FIG. 2C, in the belt drive mechanism, waterjet 122 cannot be angled relative to motor 106. Instead and in order to accommodate a more convenient retrofitting of hulls with outboard jets having belt drive mechanism (which is achieved by angling waterjet 122 in the bevel gear mechanism), the outboard jet 120 itself (both motor 106 and waterjet 122) can be tilted.

Figure 5A:
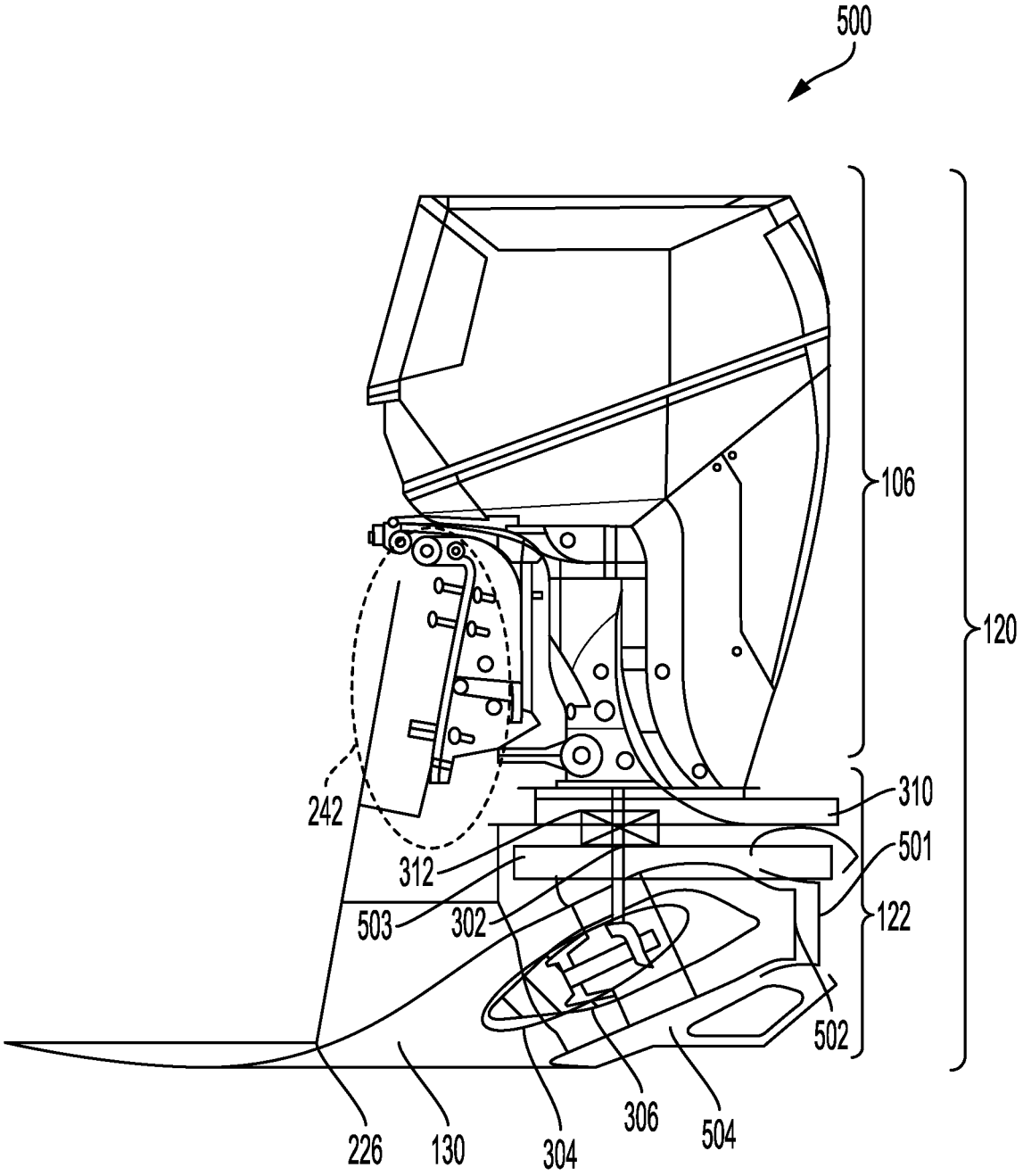
FIGS. 5A-B illustrate examples of an outboard jet with a steering mechanism, according to some aspects of the present disclosure.
Figure 5B:
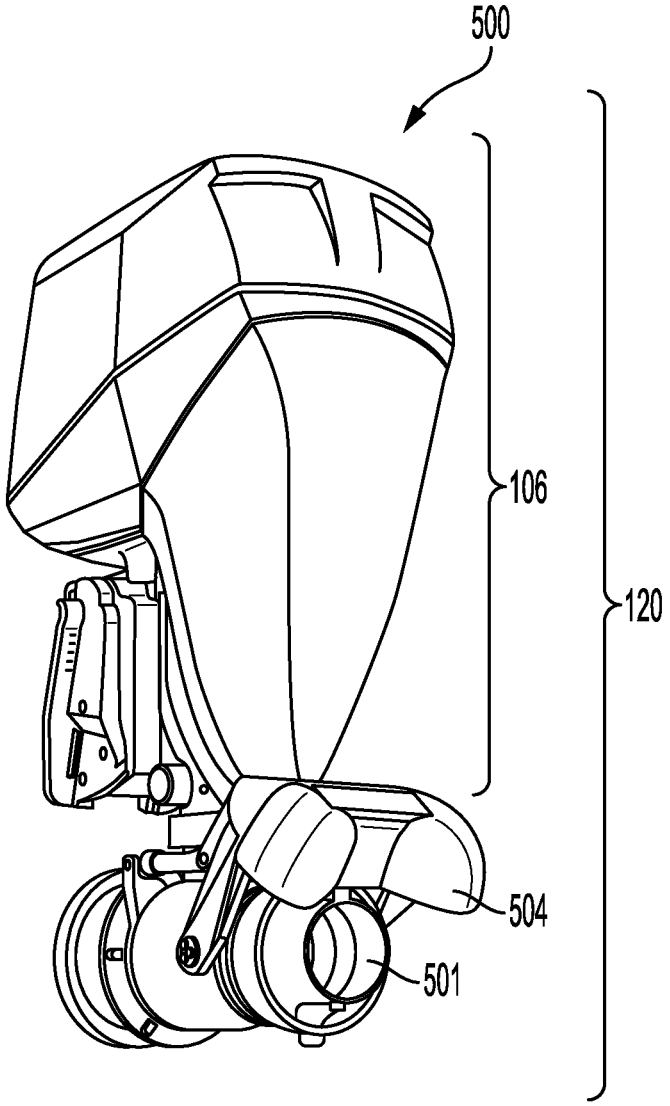

FIGS. 5A-B illustrate examples of an outboard jet with a steering mechanism, according to some aspects of the present disclosure. FIG. 5A uses an example of an outboard jet utilizing a bevel gear-based mechanism described above with reference to FIG. 3A but the same is equally application to a belt-drive mechanism described above with reference to FIGS. 3B and 3C. As shown in configuration 500 FIG. 5A, a steering nozzle 501 is provided that can be the same as steering nozzle 314 described above with reference to FIGS. 3A-C. partially and/or fully cover outlet nozzle 502 of waterjet 122, through which water is discharged to propel the vessel. Steering linkages, operating cylinders etc. can be packaged into steering envelope 503 as indicated in FIG. 5A. Steering envelope 503 may be referred to as an actuating system. Steering nozzle 501 can be made of any known or to be developed suitable component and can have any known or to be developed practical shape. Steering nozzle 501 can be controlled via components of steering envelope 503, which in turn can control a direction of movement of a vessel to which outboard jet 120 is connected. Steering nozzle 501 can have vertical, horizontal and/or sideways movement to control the outflow of water pumping out of outlet nozzle 502 and hence controlling the direction of movement of the vessel. FIG. 5A also illustrates a reverse movement mechanism 504 for controlling reverse movement of the vessel. The reverse movement mechanism 504 will be further described below with reference to FIGS. 6A-B.

FIG. 5B illustrates an outboard jet with a steering mechanism, according to some aspects of the present disclosure. FIG. 5B uses an example of an outboard jet utilizing a belt-driven mechanism described above with reference to FIGS. 3B and C. As shown, steering nozzle 501 may have horizontal and/or rotational movement to control the direction of movement of a vessel to which outboard jet 120 is coupled. FIG. 5B also illustrates the reverse steering mechanism 504 in a non-engaged position. Once engaged (e.g., covering steering nozzle 501), reverse steering mechanism 504 can create a reverse thrust causing a reverse movement of a vessel to which outboard jet 120 is coupled.

Figure 6A:
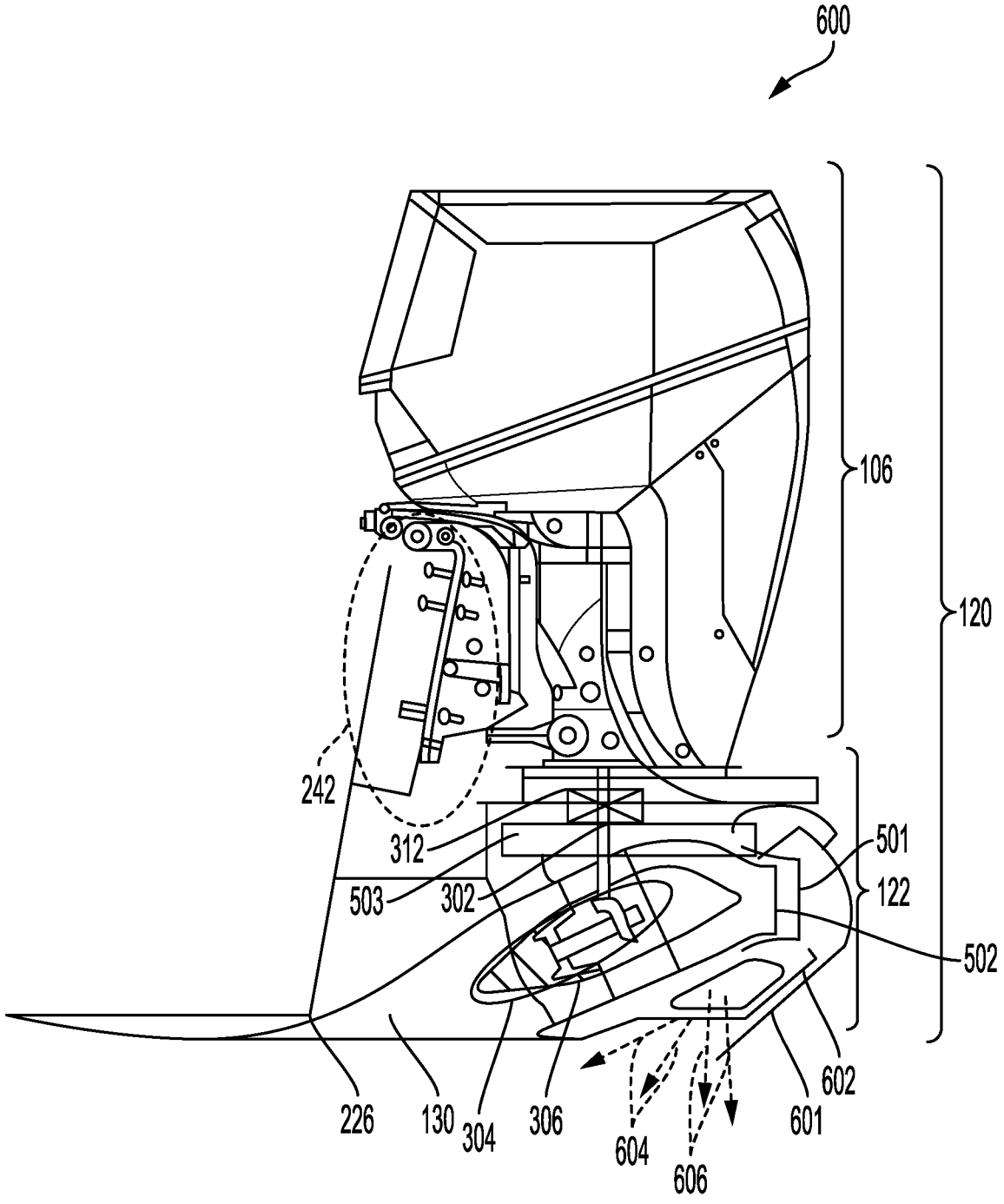
FIGS. 6A-B illustrate examples of an outboard jet with a reverse movement mechanism, according to some aspects of the present disclosure.
Figure 6B:
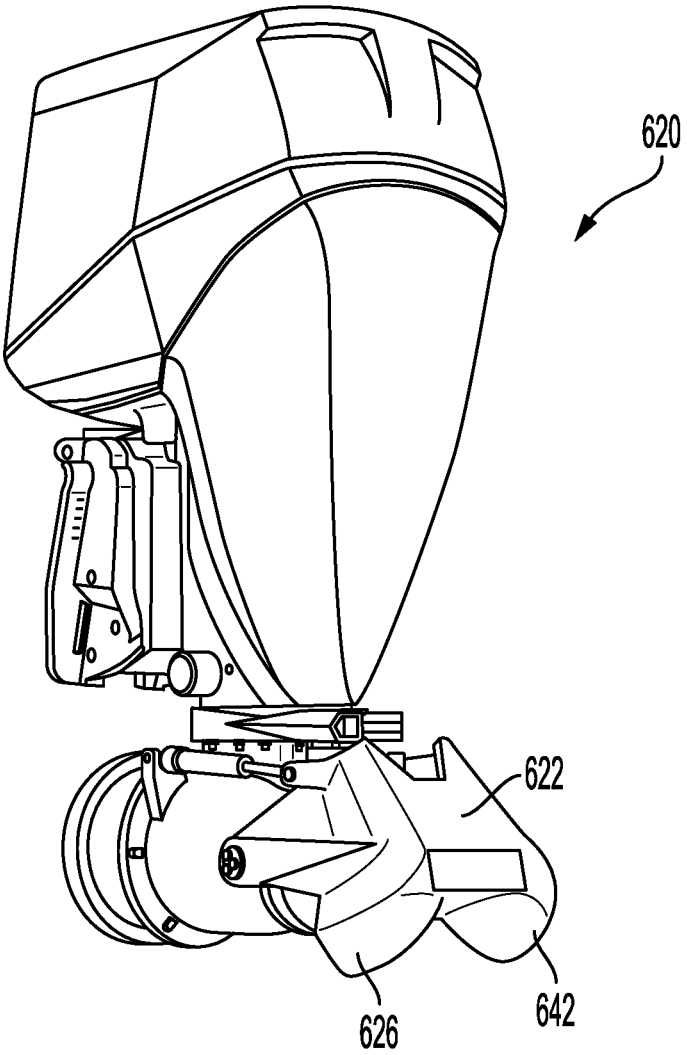

FIGS. 6A-B illustrate examples of an outboard jet with a reverse movement mechanism, according to some aspects of the present disclosure. FIG. 6A uses an example of an outboard jet utilizing a bevel gear-based mechanism described above with reference to FIG. 3A but the same is equally application to a belt-drive mechanism described above with reference to FIGS. 3B and 3C and also shown in FIG. 5B. Configuration 600 of FIG. 6A illustrates details of reverse steering mechanism 504. More specifically, reverse steering mechanism 504 can have a cap 601 that can cover a fixed ducting path 602. Cap 601 can partially and/or fully close outlet nozzle 502 to achieve degrees of astern thrust. Cap 601 can be made of any known or to be developed suitable component and can have any known or to be developed practical shape. Furthermore, steering nozzle 501 and cap 601 can be utilized in combination and controlled via, for example, steering envelope 503 to achieve various degrees and combinations of astern and side thrusts. Examples of astern and side flows are shown using arrows indicative of flow of water out of waterjet 122 when cap 601 and steering nozzle 501 are engaged. Astern flow is illustrated using arrows 604 while side flows are shown using arrows 606.

In another example and instead of a single cap 601, reverse steering mechanism 504 can have a cap with two outlet paths. An example configuration 620 of a cap 622 with two outlets is shown in FIG. 6B. Cap 601 can include two outlets 624 and 626 to provide astern thrust. This cap configuration of FIG. 6B can provide for a narrower and more compact design better suited for installing outboard jet 120 to new and/or existing vessels.

Figure 7A:
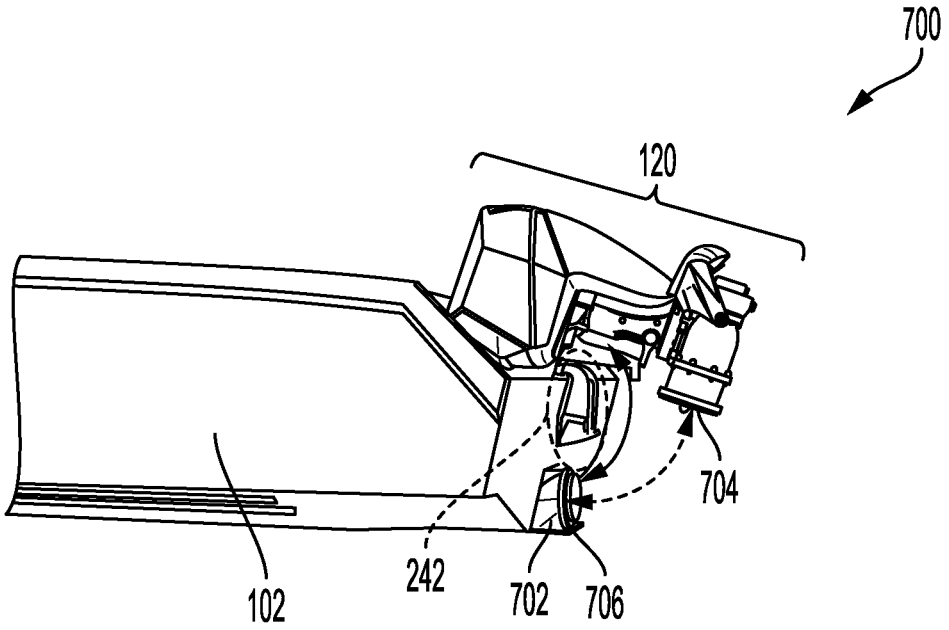
FIGS. 7A-B illustrate examples of an outboard jet with a hull adaptor, according to some aspects of the present disclosure.
Figure 7B:
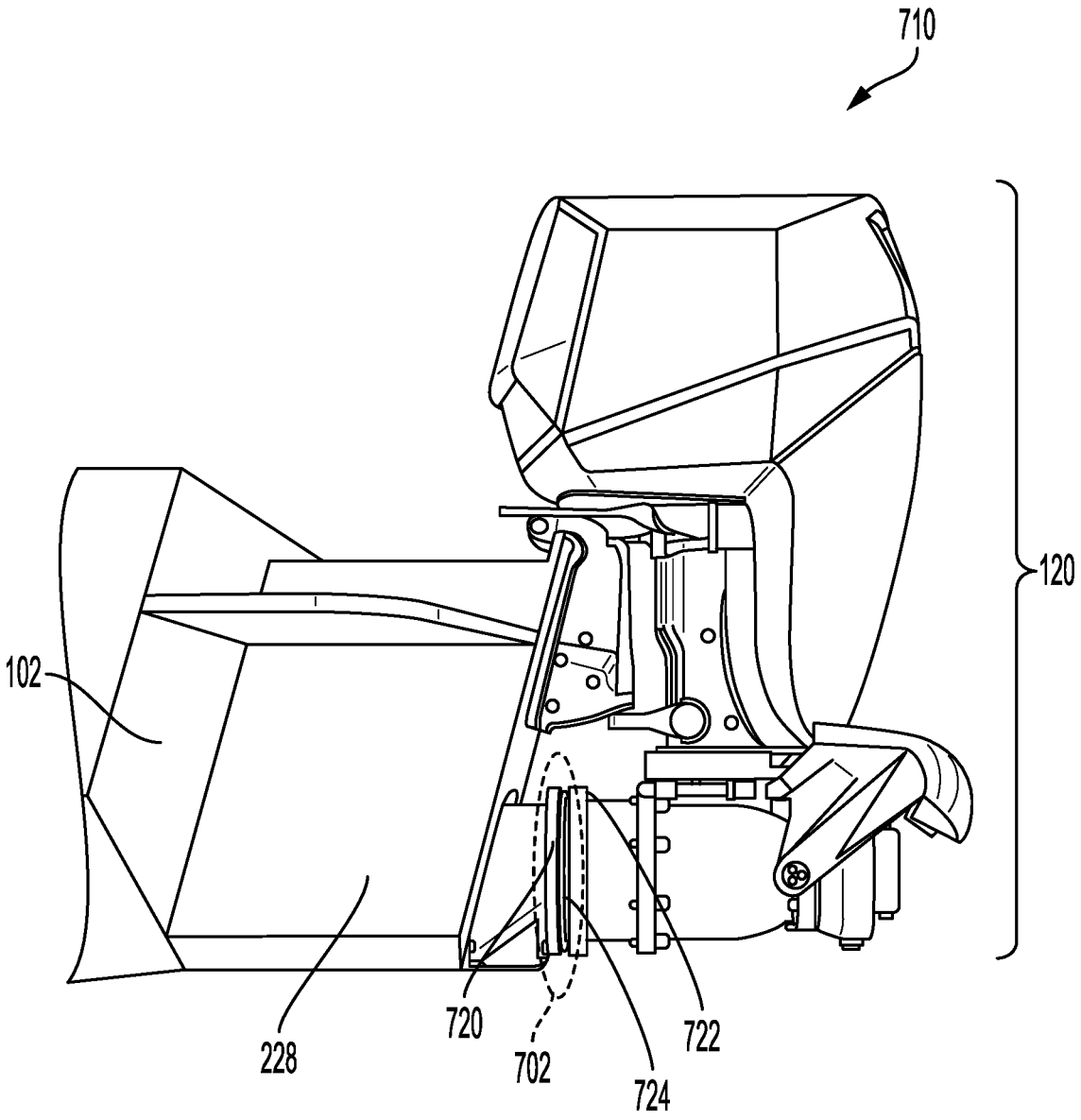

FIGS. 7A-B illustrate examples of an outboard jet with a hull adaptor, according to some aspects of the present disclosure. Configuration 700 of FIG. 7A illustrates outboard jet 120 coupled to hull 102. While outboard jet 120 is fixed to hull 102 (i.e., with no horizontal or vertical degree of freedom or movement), outboard jet 120 can be tilted (has rotational movement) about a pivot (e.g., coupling mechanism 242) between an open position (out of water or disengaged) as shown in FIG. 7A and a closed position (in water or engaged) as shown in FIG. 7B. Once closed, waterjet 122 is sealed to hull adaptor 702, allowing water from the inlet duct to flow into impeller 354-1 of waterjet 122, as described above. Hull adaptor 702 may be attached to hull 102. Use of hull adaptor 702 allows for coupling of outboard jet 120 to a wide variety of hulls and offer single, twin, triple, etc., installation. Hull adaptor 702 can be a bolt on item made from different known or to be developed suitable materials.

In some examples, hull adaptor 702 may include a sealing system. Because outboard motors are flexible mounted for vibration isolation purposes, the sealing system used between flanges (one flange at tip 704 of waterjet 122 and another flange at tip 706 of hull adaptor 702) is be sufficiently flexible to accommodate some variance in positions of waterjet 122 and hull adaptor 702 whilst maintaining necessary flange seal for the waterjet to work. This includes a suction condition and a pressure condition. In another example, flanges at tips 704 and 706 may be actively clamped together. This clamping can prevent a potential lifting of outboard motor 106. The reverse system of waterjet 122 can generate a higher reverse force than the conventional propeller can and this has the potential to "lift" the outboard motor 106 on its pivot which would cause the flanges to separate and open the chamber (e.g., chamber 425) to air causing loss of pumping. The propeller driven outboard motor 106 relies on the unit weight and a simple hydraulic cylinder within built pressure relief to hold the motor 106 down. The ordinary propulsion force pushes the unit in a downward direction, but the reverse (astern) thrust will want to lift the unit.

While configuration 700 of FIG. 7A illustrates outboard jet in a lifted position (open position), configuration 710 of FIG. 7B illustrates outboard jet 120 in a closed position where outboard jet 120 is sealed to hull adaptor 702 at tips 704 and 706 using flanges 720 and 722 described above. The described sealing system between flanges 720 and 722 is shown at 724 in FIG. 7B.

By enabling a coupling of hull adaptor 702 to waterjet 122, as shown in FIGS. 7A and 7B, the tilting capability of outboard jet 120 can be used which can be advantageous for storage and corrosion purposes and the ability for routine and/or water service of outboard jet 120. This can further provide the possibility of opening up outboard jet 120 to remove debris and more generally clean the motor 106 and/or waterjet 122.

In FIG. 7B, outboard jet 120 is shown as being coupled to hull 102 via pod 228. However, as described above, the use of pod 228 is just one non-limiting example of coupling outboard jet 120 to hull 102. Other examples include directly coupling outboard jet 120 to hull 102 such as that shown in FIG. 7A.

Although a variety of examples and other information was used to explain aspects within the scope of the appended claims, no limitation of the claims should be implied based on particular features or arrangements in such examples, as one of ordinary skill would be able to use these examples to derive a wide variety of implementations. Further and although some subject matter may have been described in language specific to examples of structural features and/or method steps, it is to be understood that the subject matter defined in the appended claims is not necessarily limited to these described features or acts. For example, such functionality can be distributed differently or performed in components other than those identified herein. Rather, the described features and steps are disclosed as examples of components of systems and methods within the scope of the appended claims.

Claim language reciting "at least one of" a set indicates that one member of the set or multiple members of the set satisfy the claim. For example, claim language reciting "at least one of A and B" means A, B, or A and B.

What is claimed is:

1. A vessel propelling system comprising:

a motor; and a waterjet system coupled to the motor, the waterjet system including a stator with a plurality of blades, a first blade of the plurality of blades having a shape that is different than remaining blades of the plurality of blades, the shape of the first blade allowing a driving mechanism of the motor to pass through to be coupled to a shaft within the waterjet system, wherein the first blade has a length and a thickness that are relatively larger compared to a corresponding length and a corresponding thickness of the remaining blades of the plurality of blades, and a second blade of the plurality of blades has a length that is smaller than the length of the first blade but is relatively longer compared to a corresponding length of a subset of the remaining blades of the plurality of blades.

2. The vessel propelling system of claim 1, wherein blades of the subset of the remaining blades are of the same shape and size.

3. The vessel propelling system of claim 1, wherein corresponding lengths or and corresponding thicknesses of the first blade, the second blade and the subset of the blades are configured to straighten a flow of incoming water before exiting a channel of the stator.

4. The vessel propelling system of claim 1, wherein the driving mechanism is a belt-driven mechanism, whereby a belt vertically extends from the motor through a blade of the stator and is connected to a shaft of an impeller of the waterjet system.

5. The vessel propelling system of claim 4, wherein a hull adaptor is configured to couple the vessel propelling system to an inlet duct formed in a vessel, the vessel propelling system configured to propel the vessel.

6. The vessel propelling system of claim 1, wherein the driving mechanism is a gear-based mechanism configured to couple a vertical shaft extending from the motor with a shaft in the waterjet system, thereby causing rotational movement of an impeller of the waterjet system.

7. The vessel propelling system of claim 6, wherein a hull adaptor is configured to couple the vessel propelling system to an inlet duct formed in a vessel, the vessel propelling system configured to propel the vessel.

8. The vessel propelling system of claim 7, wherein the inlet duct is formed into a recess in an aft of a hull of the vessel.

9. The vessel propelling system of claim 7, wherein the inlet duct is fitted into an opening of a pod attached to a rear of the vessel.

10. The vessel propelling system of claim 9, wherein the pod is configured to allow attaching the vessel propelling system to a hull of a vessel without a recess for the inlet duct.

11. The vessel propelling system of claim 7, wherein the hull adaptor is coupled to the vessel propelling system using a sealing system.

12. The vessel propelling system of claim 7, wherein the vessel propelling system is coupled to the vessel about a pivot allowing the vessel propelling system to be decoupled from an inlet duct of the vessel and lifted out of the water.

13. The vessel propelling system of claim 1, wherein the waterjet system includes a steering nozzle for controlling a direction of movement of a vessel to which the vessel propelling system is attached.

14. The vessel propelling system of claim 13, wherein the steering nozzle is configured to be controlled by an actuating system attached to the vessel propelling system.

15. The vessel propelling system of claim 1, wherein the waterjet system is configured to attach to the motor at an angle to accommodate for a shorter horizontal length of an inlet of the waterjet system when the vessel propelling system is installed to a vessel.

16. A vessel propelling system comprising:

a motor; and a waterjet system coupled to the motor via a belt extending vertically from the motor and coupled to a shaft of the waterjet system, the waterjet system including:

an impeller; and a stator with a plurality of blades, a first blade of the plurality of blades having a shape that is different than remaining blades of the plurality of blades, the shape of the first blade allowing the belt to pass through to be coupled to the shaft within the waterjet system, wherein the first blade has a length and a thickness that are relatively larger compared to a corresponding length and a corresponding thickness of the remaining blades of the plurality of blades, and a second blade of the plurality of blades has a length that is smaller than the length of the first blade but is relatively longer compared to a corresponding length of a subset of the remaining blades of the plurality of blades.

* * * * *